US008629740B2

(12) United States Patent
Ninomiya et al.

(10) Patent No.: US 8,629,740 B2
(45) Date of Patent: Jan. 14, 2014

(54) BANDPASS FILTER, WIRELESS COMMUNICATION MODULE AND WIRELESS COMMUNICATION DEVICE

(75) Inventors: Hiroshi Ninomiya, Kirishima (JP); Katsuro Nakamata, Kirishima (JP); Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 861 days.

(21) Appl. No.: 12/580,963

(22) Filed: Oct. 16, 2009

(65) Prior Publication Data

US 2010/0033271 A1 Feb. 11, 2010

Related U.S. Application Data

(63) Continuation-in-part of application No. PCT/JP2008/056071, filed on Mar. 28, 2008.

(30) Foreign Application Priority Data

Apr. 18, 2007 (JP) ..... 2007-109624
Nov. 28, 2007 (JP) ..... 2007-306893

(51) Int. Cl.
*H01P 1/203* (2006.01)
*H01P 7/08* (2006.01)

(52) U.S. Cl.
USPC ..... 333/204; 333/219

(58) Field of Classification Search
USPC ..... 333/204, 205, 219, 135
See application file for complete search history.

(56) References Cited

U.S. PATENT DOCUMENTS

| | | | | |
|---|---|---|---|---|
| 5,376,908 | A * | 12/1994 | Kawaguchi et al. | 333/203 |
| 6,456,172 | B1 | 9/2002 | Ishizaki et al. | |
| 7,116,188 | B2 * | 10/2006 | Kawahara et al. | 333/134 |
| 2005/0052262 | A1 * | 3/2005 | Fukunaga et al. | 333/204 |
| 2007/0171004 | A1 * | 7/2007 | Kayano | 333/204 |
| 2007/0176712 | A1 * | 8/2007 | Tomaki et al. | 333/204 |

FOREIGN PATENT DOCUMENTS

| | | |
|---|---|---|
| JP | 2001-189605 A | 7/2001 |
| JP | 2004-140878 A | 5/2004 |
| JP | 2004-180032 A | 6/2004 |

OTHER PUBLICATIONS

Li, K. et al., "An Ultra-Wideband Bandpass Filter Using Broadside-Coupled Microstrip—Coplanar Waveguide Structure", Proceedings of the IEICE General Conference, Mar. 2005, C-2-114, pp. 147.

* cited by examiner

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

A bandpass filter for a wide frequency band such as UWB is disclosed. The bandpass filter comprises a laminate of a plurality of dielectric layers, a first ground electrode connected to a ground potential, a plurality of resonant electrodes in a first inter-layer and a plurality of coupling electrodes in a second inter-layer. A transmission characteristic of the bandpass filter having flat and low loss over the entire region of the broad pass band can be achieved.

5 Claims, 19 Drawing Sheets

100

103
41a
22
41b 420a
42a
102
45a
D1
D2
45b
420b
42b 31a
23
31b
101
31c
31d
101b 21
101a
Y
X

500

103
41a
22
41b 42a
45a
102
45b
42b 101
31a
31aE
31bE
31b
31c
31cE
23
31dE
31d 32a
32b
104
32c
32d 104a
21
Y
X

1300

103
41a
22
41b 461a
46a
107
462a
46b
462b
461b 45a
42a
32a
102
322a
321a
321d
321d
42b
32d
45b 31a
101
31b
24a
31c
24
31d
240
24b 321d
321d
104
32b
32c
322a
321a 104a
21
Y
X

BANDPASS FILTER, WIRELESS COMMUNICATION MODULE AND WIRELESS COMMUNICATION DEVICE

CROSS-REFERENCE TO RELATED APPLICATION

The present application is a continuation in part based on PCT Application No. JP2008/056071, filed on Mar. 28, 2008, which claims the benefit of Japanese Application No. 2007-109624, filed on Apr. 18, 2007, and Japanese Application No. 2007-306893, filed on Nov. 28, 2007 both entitled "BANDPASS FILTER, WIRELESS COMMUNICATION MODULE USING SAME AND WIRELESS COMMUNICATION DEVICE". The contents of which are incorporated by reference herein in their entirety.

FIELD OF THE INVENTION

Embodiments of the present invention relate generally to band path filters, and more particularly relate to a band path filter with a wide band suitable for UWC (Ultra Wide Band).

BACKGROUND

In recent years, an Ultra Wide Band (UWB) has drawn attention as a new communication means. UWB transmits amounts of data using a broad frequency band over a short distance such as 10 m or 33 feet. A frequency band of 3.1 to 10.6 GHz, for example, is subjected to use for UWB according to the rule of U.S. FCC (Federal Communication Commission). As such, a feature of UWB is to utilize a broad frequency band. Japan and the ITU-R have a plan to introduce standards separated into a low band of about 3.1 to 4.7 GHz and a high band of about 6 GHz to 10.6 GHz to avoid a band of 5.3 GHz that is used in the IEEE802.11a standard. Accordingly, a low band filter requires the characteristic of being abruptly attenuated at 2.5 GHz and 5.3 GHz.

Therefore, there is a need for a bandpass filter which can is applicable for an appropriate wide pass band use such as UWB.

SUMMARY

A bandpass filter for a wide frequency band such as UWB is disclosed. A transmission characteristic of the bandpass filter having flat and low loss over the entire region of the broad pass band can be achieved.

A first embodiment comprises a bandpass filter. The bandpass filter comprises a laminate, a ground electrode on or in the laminate, a plurality of resonant electrodes, an input coupling electrode and an output coupling electrode. The laminate comprises a plurality of dielectric layers. The plurality of resonant electrodes is located in a first inter-layer portion of the laminate. The plurality of resonant electrodes comprises an input resonant electrode, an output resonant electrode and one or more resonant electrodes. The input resonant electrode, the output resonant electrode and the one or more resonant electrodes are in parallel. Each of the input resonant electrode, the output resonant electrode and the one or more resonant electrodes has a ground end and an open end. The ground ends of the input resonant electrode, the output resonant electrode and the one or more resonant electrodes are aligned, and the ground ends are connected to a ground potential. The input coupling electrode and the output coupling electrode are located in a second inter-layer portion of the laminate, and each has a strip shape. The input coupling electrode faces at least a half of a length of the input resonant electrode and comprises a signal input point operable to input an electric signal. The signal input point is located between an end of the input coupling electrode near the open end of the input resonant electrode and a center of a facing area of the input coupling electrode which faces the input resonant electrode. The output coupling electrode faces at least a half of a length of the output resonant electrode, and comprises a signal output point operable to output an electric signal. The comprising a signal output point is located between an end of the output coupling electrode near the open end of the output resonant electrode and a center of a facing area of the output coupling electrode which faces the output resonant electrode.

A second embodiment comprises a high frequency module. The high frequency module comprises a bandpass filter mentioned above, a physical layer circuit connected to the bandpass filter and a medium access control circuit connected to the physical layer circuit.

A third embodiment comprises a radio communication device. The radio communication device comprises a bandpass filter mentioned above, a physical layer circuit connected to the bandpass filter, a medium access control circuit connected to the physical layer circuit and an antenna connected to the bandpass filter.

BRIEF DESCRIPTION OF THE DRAWINGS

Embodiments of the present invention are hereinafter described in conjunction with the following figures, wherein like numerals denote like elements. The figures are provided for illustration and depict exemplary embodiments of the invention. The figures are provided to facilitate understanding of the invention without limiting the breadth, scope, scale, or applicability of the invention. The drawings are not necessarily made to scale.

DETAILED DESCRIPTION OF EXEMPLARY EMBODIMENTS

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the invention. Furthermore, there is no intention to be bound by any expressed or implied theory presented in the preceding technical field, background, brief summary or the following detailed description. The present disclosure should be accorded scope consistent with the claims, and not limited to the examples described and shown herein.

Embodiments of the disclosure are described herein in the context of practical non-limiting applications, namely, bandpass filters. Embodiments of the disclosure, however, are not limited to such bandpass filters, and the techniques described herein may also be utilized in other filter applications. For example, embodiments are not limited to a wide bandpass filter and may be applicable to a wireless communication module, wireless communication device, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
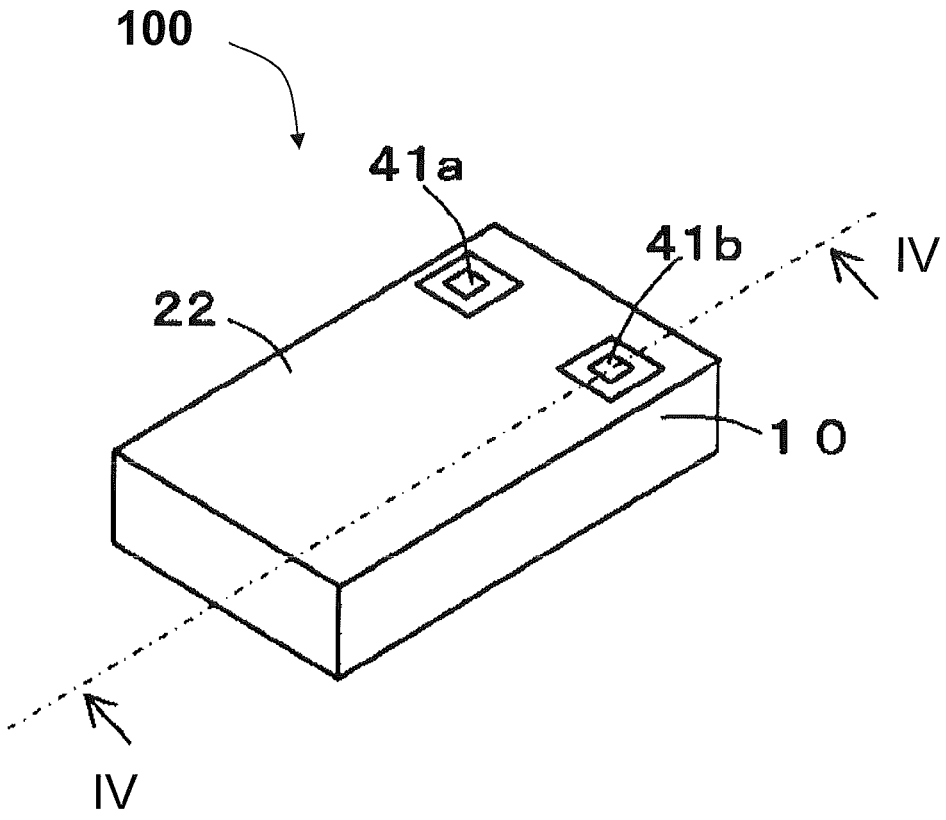
FIG. 1 is a perspective view schematically illustrating the external appearance of a bandpass filter according to one embodiment of the present invention.
Figure 2:
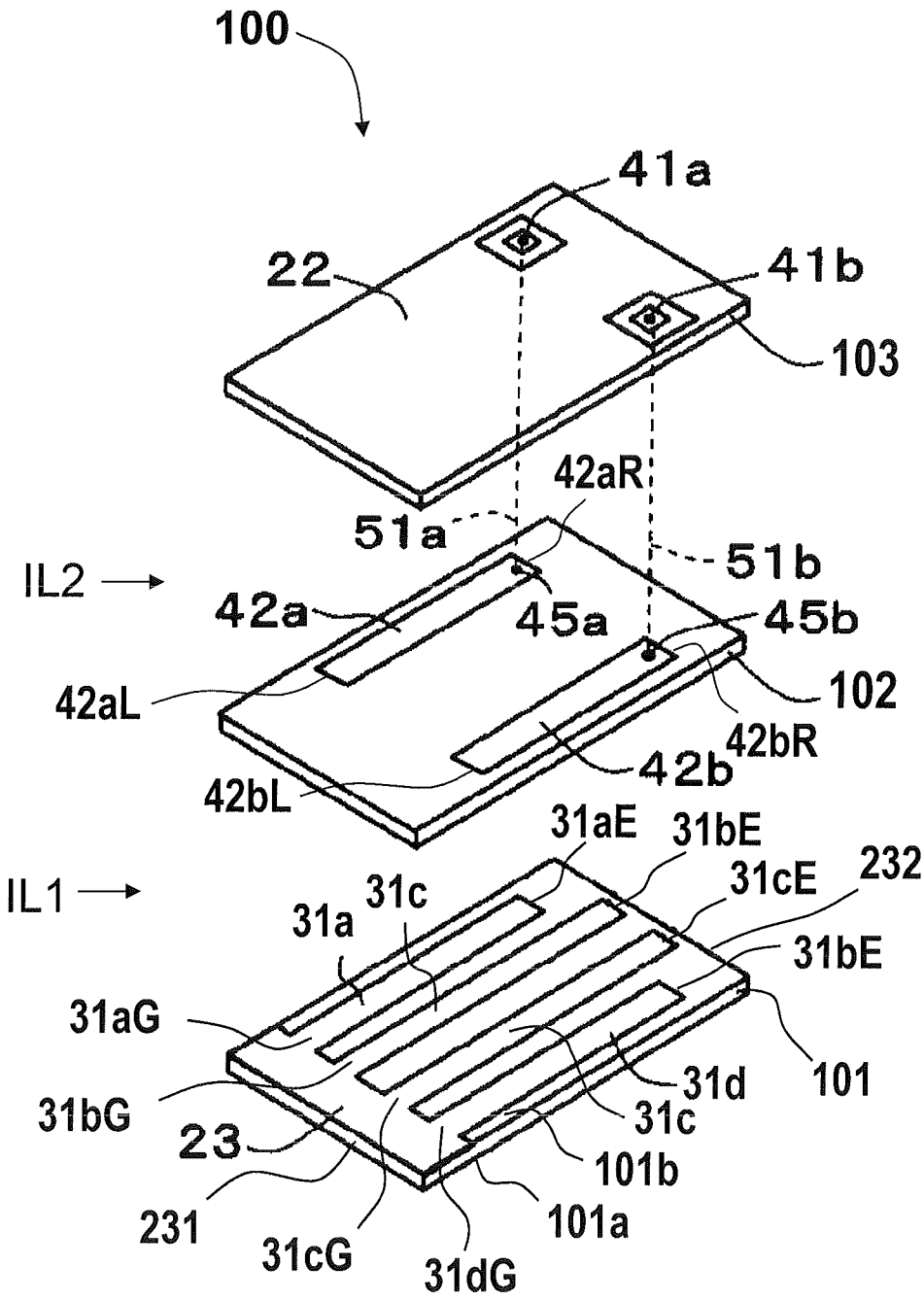
FIG. 2 is an exploded perspective view schematically illustrating the bandpass filter shown in FIG. 1.
Figures 3A, 3B, 3C, 3D:
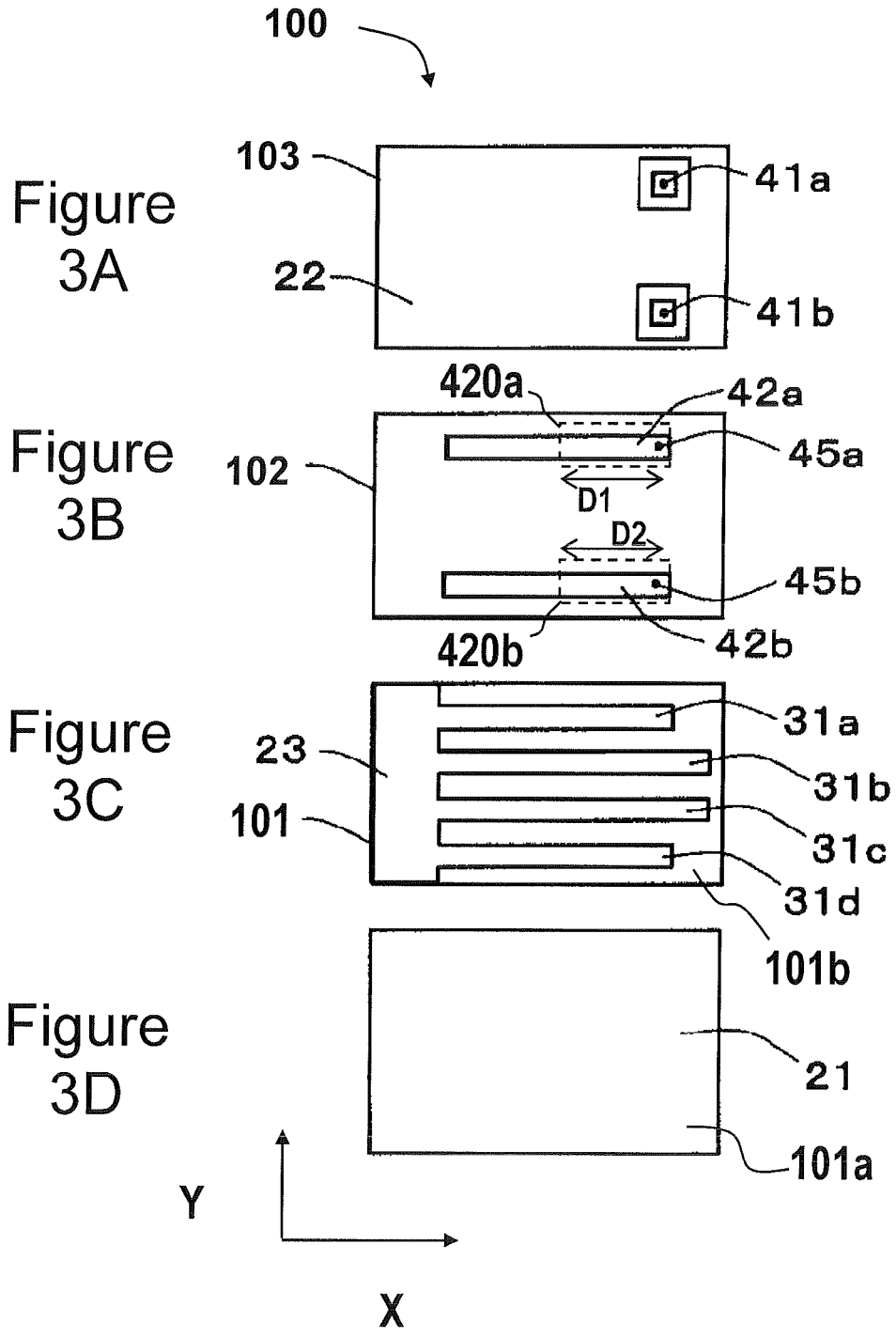
FIG. 3A is a plan view schematically illustrating a top surface of the bandpass filter shown in FIG. 1.
FIGS. 3B to 3C are plan views schematically illustrating inter-layers of the bandpass filter shown in FIG. 1.
FIG. 3D is a plan view schematically illustrating a bottom surface of the bandpass filter shown in FIG. 1.
Figure 4:
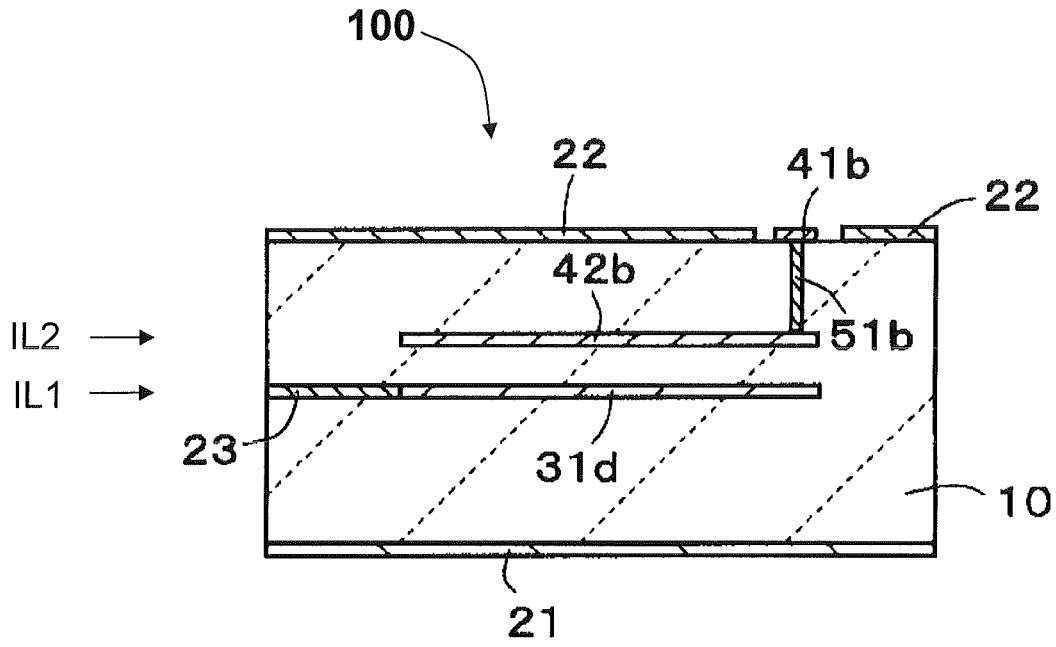
FIG. 4 is a cross sectional view taken along the line IV-IV shown in FIG. 1.

FIG. 1 is a perspective view schematically illustrating the external appearance of a bandpass filter according to one embodiment of the present invention. FIG. 2 is an exploded perspective view schematically illustrating the bandpass filter shown in FIG. 1. FIG. 3A is a plan view schematically illustrating a top surface of the bandpass filter shown in FIG. 1. FIGS. 3B to 3C are plan views schematically illustrating inter-layers of the bandpass filter shown in FIG. 1. FIG. 3D is a plan view schematically illustrating a bottom surface of the bandpass filter shown in FIG. 1. FIG. 4 is a cross sectional view taken along the line IV-IV shown in FIG. 1.

The bandpass filter 100 according to one embodiment of the present invention comprises a laminate 10. The laminate 10 comprises a plurality of dielectric layers 101, 102 and 103 which are laminated. In other words, the laminate 10 comprises a plurality of inter-layers IL1 and IL2. IL1 is located between the dielectric layers 101 and 102. IL2 is located between the dielectric layers 102 and 103. The number of the dielectric layers is not limited to three or the number of the inter-layers is not limited to two. Some of dielectric layers may be shown and the other may not be shown in the figures.

The bandpass filter 100 may comprise a first ground electrode 21, a second ground electrode 22, and a third ground electrode 23. These ground electrodes 21, 22 and 23 are connected to a ground potential.

The first ground electrode 21 is located on the bottom surface of the laminate 10. In other words, the first ground electrode 21 is disposed on a lower surface 101*a* of the dielectric layer 101. The first ground electrode 21 may, without limitation, cover the entire surface of the lower surface 101*a*. In an embodiment, one or more additional dielectric layers (not shown) may be arranged under the first ground electrode 21 to sandwich the first ground electrode 21 with the dielectric layer 101. That is, the first ground electrode 21 can be inside the laminate 10.

The second ground electrode 22 is located on the top surface of the laminate 10. In other words, the second ground electrode 22 is located on an upper surface of the dielectric layer 103. The second ground electrode 22 may, without limitation, cover the entire surface of the upper surface of the dielectric layer 103 except an input terminal electrode 41*a*, an output terminal electrode 41*b* and their peripheries. In an embodiment, one or more additional dielectric layers (not shown) may be attached on the second ground electrode 22 to sandwich the second ground electrode 22 with the dielectric layer 103. That is, the first ground electrode 21 and/or the second ground electrode 22 can be inside the laminate 10.

The third ground electrode 23 is located at a left side 231 of an upper surface 101*b* of the dielectric layer 101. The third ground electrode 23 may have a rectangular shape. The third ground electrode 23 can share a left side 231 with one side of the dielectric layer 101. The width of the third ground electrode 23 may have the same width of the dielectric layer 101.

The bandpass filter 100 may comprise an input terminal electrode 41*a* and an output terminal electrode 41*b*. Hereinafter, the input terminal electrode 41*a* and the output terminal electrode 41*b* may be referred to terminal electrodes 41*a* and 41*b*. The terminal electrodes 41*a* and 41*b* may be located on the upper surface of the dielectric layer 103 of the laminate 10. An electric signal may be input to the input terminal electrode 41*a* from an external circuit and an electric signal may be output to an external circuit from the output terminal electrode 41*b*.

The bandpass filter 100 further comprises a first resonant electrode 31*a*, a second resonant electrode 31*b*, a third resonant electrode 31*c* and a fourth resonant electrode 31*d*. Since an electric signal is inputted to the first resonant electrode 31*a*, the first resonant electrode 31*a* may be referred to an input resonant electrode 31*a*. Similarly, the fourth resonant electrode 31*d* may be referred to an output resonant electrode 31*d* since an electric signal is outputted from the fourth resonant electrode 31*d* outputs. The first resonant electrode 31*a*, the second resonant electrode 31*b*, the third resonant electrode 31*c* and the fourth resonant electrode 31*d* may be referred to resonant electrodes 31*a*, 31*b*, 31*c* and 31*d*.

The resonant electrodes 31*a*, 31*b*, 31 and 31*d* are located on the upper surface 101*b* of the dielectric layer 101 on which the third ground electrode is located. This surface may be referred to a first inter-layer portion IL1 of the laminate 10.

The resonant electrodes 31*a*, 31*b*, 31 and 31*d* are arranged in parallel with each other in the longitudinal direction (X direction in FIGS. 3A to 3D) on the dielectric layer 101. The resonant electrodes 31*a*, 31*b*, 31 and 31*d* are separated each other by a predetermined distance (or an interval). A group of the second resonant electrodes 31*b* and the third resonant electrodes 31*c* is sandwiched by the input resonant electrode 31*a* and the output resonant electrode 31*d*.

The resonant electrodes 31*a*, 31*b*, 31*c* and 31*d* can have strip shapes. The lengths of the resonant electrodes 31*a*, 31*b*, 31*c* and 31*d* may be different. As illustrated in FIGS. 2 and 3, the second resonant electrode 31*b* and the third resonant electrode 31*c* may be longer than the input resonant electrode 31*a* and the output resonant electrode 31*d*. This is because the lengths of the resonant electrodes are adjusted to obtain a wide band frequency. Also, the intervals between two of the resonant electrodes 31*a*, 31*b*, 31*c* and 31*d* can be adjusted in addition to the lengths of the resonant electrodes 31*a*, 31*b*, 31*c* and 31*d*.

As the intervals between two of the resonant electrodes 31*a*, 31*b*, 31*c* and 30*d* become narrower, the couplings may be stronger. However, if the intervals become too narrow, the difficulty in manufacturing the resonant electrodes 31*a*, 31*b*, 31 and 31*d* may increase. Accordingly, the interval between two of the resonant electrodes 31*a*, 31*d*, and 31*c* may be set, without limitation, about 0.01 to about 0.3 mm.

The input resonant electrode 31*a* (or the first resonant electrode) comprises a first open end 31*a*E and a first ground end 31*a*G. The second resonant electrode 31*b* comprises a second open end 31*b*E and a second ground end 31*b*G. The third resonant electrode 31*c* comprises a third open end 31*c*E and a third ground end 31*c*G. The output resonant electrode 31*d* (or the fourth resonant electrode) comprises a fourth open end 31*d*E and a fourth ground end 31*d*G. The open ends 31*a*E, 31*b*E, 31*c*E and 31*d*E are located near a left side 232 of the dielectric layer 101.

The ground ends 31*a*G, 31*b*G, 31*c*G and 31*d*E are aligned such that the electromagnetic field coupling is mutually provided, thereby mutually providing edge coupling. The ground ends of the resonant electrodes 31*a*, 31*b*, 31 and 31*d* are connected to the third ground electrode 23. That is, the first ground end 31*a*G, the second ground end 31*b*G, the third ground end 31*c*G and the fourth ground end 31*d*G are connected to the third ground electrode 23. Therefore, the ground ends 31*a*G, 31*b*G, 31*c*G and 31*d*E are connected to the ground potential, and the resonant electrodes are coupled in the form of the comb-line type.

Both of the first ground electrode 21 and the second ground electrode 22 are connected to the ground potential, and therefore, the first ground electrode 21 and the second ground electrode 22 constitute a strip line resonator along with the resonant electrodes 31*a*, 31*b*, 31*c* and 31*d*. Since the ground ends of the resonant electrodes 31*a*, 31*b*, 31*c* and 31*d* are connected to the third ground electrode 23, each of the resonant electrodes 31*a*, 31*b*, 31*c* and 31*d* serve as a ¼ wavelength resonator.

The input resonant electrode 31*a*, the second resonant electrode 31*b*, the third resonant electrode 31*c* and the output resonant electrode 31*d* are coupled electromagnetically (edge coupled) with each other.

As such, since the resonant electrodes 31*a*, 31*b*, 31 and 31*d* are mutually edge-coupled and the stronger coupling is obtained with the less intervals, the frequency interval between resonance frequencies in each resonance mode is adapted to be appropriate to gain a broad pass band width on the order of 40% by the relative bandwidth which is well in excess of the region that can be realized by the conventional filter using the ¼ wavelength resonators and is appropriate as a bandpass filter for UWB.

In addition, it may not be preferable to make a coupling between the plurality of resonant electrodes 31*a*, 31*b*, 31 and 31*d* in an inter-digital type and make a broad-side coupling therebetween as well because the coupling may become too strong to achieve the pass band width of about 40% by the relative bandwidth.

The bandpass filter 100 further comprises an input coupling electrode 42*a* and an output coupling electrode 42*b*. Hereinafter, a group of the input coupling electrode 42*a* and the output coupling electrode 42*b* may be called as coupling electrodes 42*a* and 42*b*. Each of the coupling electrodes 42*a* and 42*b* can have strip shapes.

The coupling electrodes 42*a* and 42*b* are located on an upper surface of a dielectric layer 102 of the laminate 10. This surface may be referred to a second inter-layer portion IL2 of the laminate 10.

The input coupling electrode 42*a* comprises a right input end 42*a*R and a left input end 42*a*L. The left input end 42*a*L may face the first ground end 31*a*G of the input resonant electrode 31*a*. The output coupling electrode 42*b* comprises a right input end 42*b*R and a left input end 42*b*L. The left input end 42*b*L may face the fourth ground end 31*d*G of the output resonant electrode 31*d*.

The input coupling electrode 42*a* comprises a signal input point 45*a* near the right end 42*a*R thereof. The output coupling electrode 42*b* comprises a signal output point 45*b* near the right end 42*b*R thereof.

The signal input point 45*a* may be located at a region 420*a* which has the length D from the right end 42*a*R of the input coupling electrode 42*a* in a longitudinal direction which is equal to X direction in FIGS. 3A to 3D. The length D1 is less than a half length of the area facing the input resonant electrode 31*a* in the longitudinal direction. In an embodiment shown in FIGS. 1 to 4, the area facing the input resonant electrode 31*a* in the longitudinal direction is equal to the entire length of the input coupling electrode 42*a* so that D is equal to a half length of the input coupling electrode 42*a*.

In the same manner, the signal output point 45*b* may be located at a region 420*b* which has the length D2 from the right end 42*b*R of the output coupling electrode 42*b* in the longitudinal direction. The length D2 is less than a half length of the area facing the output resonant electrode 31*d* in the longitudinal direction. In an embodiment shown in FIGS. 1 to 4, the area facing the output resonant electrode 31*d* in the longitudinal direction is equal to the entire length of the input coupling electrode 42*a* so that D is equal to a half length of the input coupling electrode 42*a*.

In an embodiment, the dimensions of the coupling electrodes 42*a* and 42*b* may be similar, or equal to those of the resonant electrodes 31*a* and 31*d*. In an embodiment shown in FIGS. 1 to 4, the coupling electrodes 42*a* and 42*b* and the resonant electrodes 31*a* and 31*d* have the same shape. That is, the total dimension of the input coupling electrodes 42*a* may be substantially identical to the first resonant electrode 31*a*. Similarly, the total shape dimension of the output coupling electrodes 42*b* may be substantially identical to the output resonant electrode 31*d*.

The bandpass filter 100 may comprise penetration conductors 51*a* and 51*b* which penetrate the dielectric layer 103. The penetration conductor 51*a* (indicated by a dotted line in FIG. 2) connects the input terminal electrode 41*a* to the signal input point 45*a* of the input coupling electrode 42*a*. The penetration conductor 51*b* (indicated by a dotted line in FIG. 2) connects the output terminal electrode 41*b* to the signal output point 45*b* of the output coupling electrode 42*b*.

The input coupling electrodes 42*a* on the dielectric layer 102 faces the input resonant electrode 31*a* on the dielectric layer 101 such that an electromagnetical coupling is provided between the input coupling electrodes 42*a* and the input resonant electrode 31*a*. In other words, the input coupling electrode 42*a* faces a first facing area of the input resonant electrode 31*a* having a length more than a half of the input resonant electrode 31*a*, and therefore, is operable to be electromagnetically coupled to the first facing area of the input resonant electrode 31*a*.

Accordingly, the input coupling electrode 42*a* and the first resonant electrode 31*a* are broad-side coupled to each other, and therefore, the coupling becomes stronger than the edge-coupling.

Therefore, the input coupling electrodes 42*a* and the input resonant electrode 31*a* are operable to be coupled to each other in an inter-digital type, and therefore, a coupling by magnetic fields are added to a coupling by electric fields, so that the coupling becomes stronger than the comb-line type coupling alone or capacitive coupling alone.

As such, since the input coupling electrode 42*a* can be not only broad-side coupled but also coupled in an inter-digital type with the input resonant electrode 31*a*, the input coupling electrode 42*a* ends up to be coupled to the input resonant electrode 31*a* strongly.

Similarly, the output coupling electrode 42*b* faces the output resonant electrode 31*d*, and can be coupled to the output resonant electrode 31*d*. In other words, the output coupling electrode 42*b* faces the output resonant electrode 31*d*, and therefore, is operable to be electromagnetically coupled to the second resonant electrodes 31*d*. Accordingly, the output coupling electrode 42*b* and the output resonant electrode 31*d* are broad-side coupled to each other, and therefore, the coupling becomes stronger than the edge-coupling.

Therefore, the output coupling electrodes 42*b* and the output resonant electrode 31*d* are operable to be coupled to each other in an inter-digital type, and therefore, a coupling by magnetic fields are added to a coupling by electric fields, so that the coupling becomes stronger than the comb-line type coupling alone or capacitive coupling alone.

As such, since the output coupling electrode 42*b* can be not only broad-side coupled but also coupled in an inter-digital type with the output resonant electrode 31*d*, the output coupling electrode 42*b* ends up to be coupled to the output resonant electrode 31*d* strongly.

Since the coupling between the input coupling electrodes 42*a* and the first resonant electrode 31*a* is strong and the coupling between the output coupling electrodes 42*b* and the output resonant electrode 31*d* is strong, a bandpass filter may be obtained, whose insertion loss is not greatly increased at frequencies located between resonance frequencies in each resonance mode even in the broad pass band width well in excess of the region that may be achieved by the conventional filter using the ¼ wavelength resonator, and which has a flat and low-loss transmission characteristic over the entire region of the broad pass band.

As the distance between the input coupling electrode 42*a* and the input resonant electrode 31*a*, and the distance between the output coupling electrode 42*b* and the output resonant electrode 31*d* become smaller, the couplings may become stronger but they may become difficult to be manufactured. Therefore, the distances may be set, for example and without limitation, to about 0.01 to about 0.3 mm.

In one embodiment, the input terminal electrode 41*a* and output terminal electrode 41*b* may be omitted if, for example and without limitation, a bandpass filter is formed inside of a module substrate.

Figure 5:
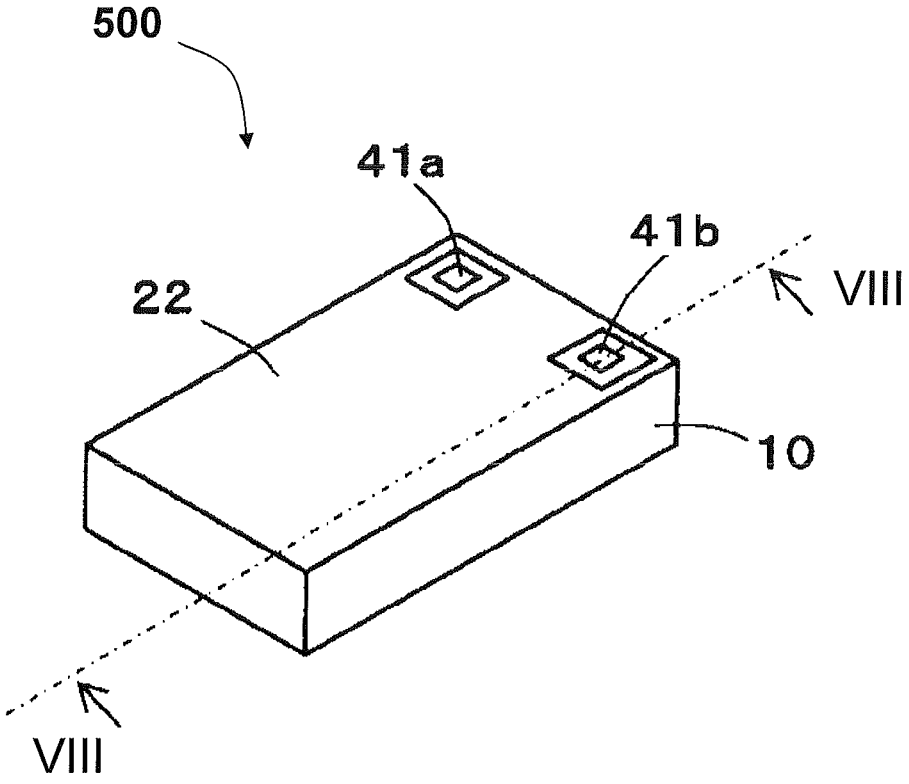
FIG. 5 is a perspective view schematically illustrating the external appearance of a bandpass filter according to one embodiment of the present invention.
Figure 6:
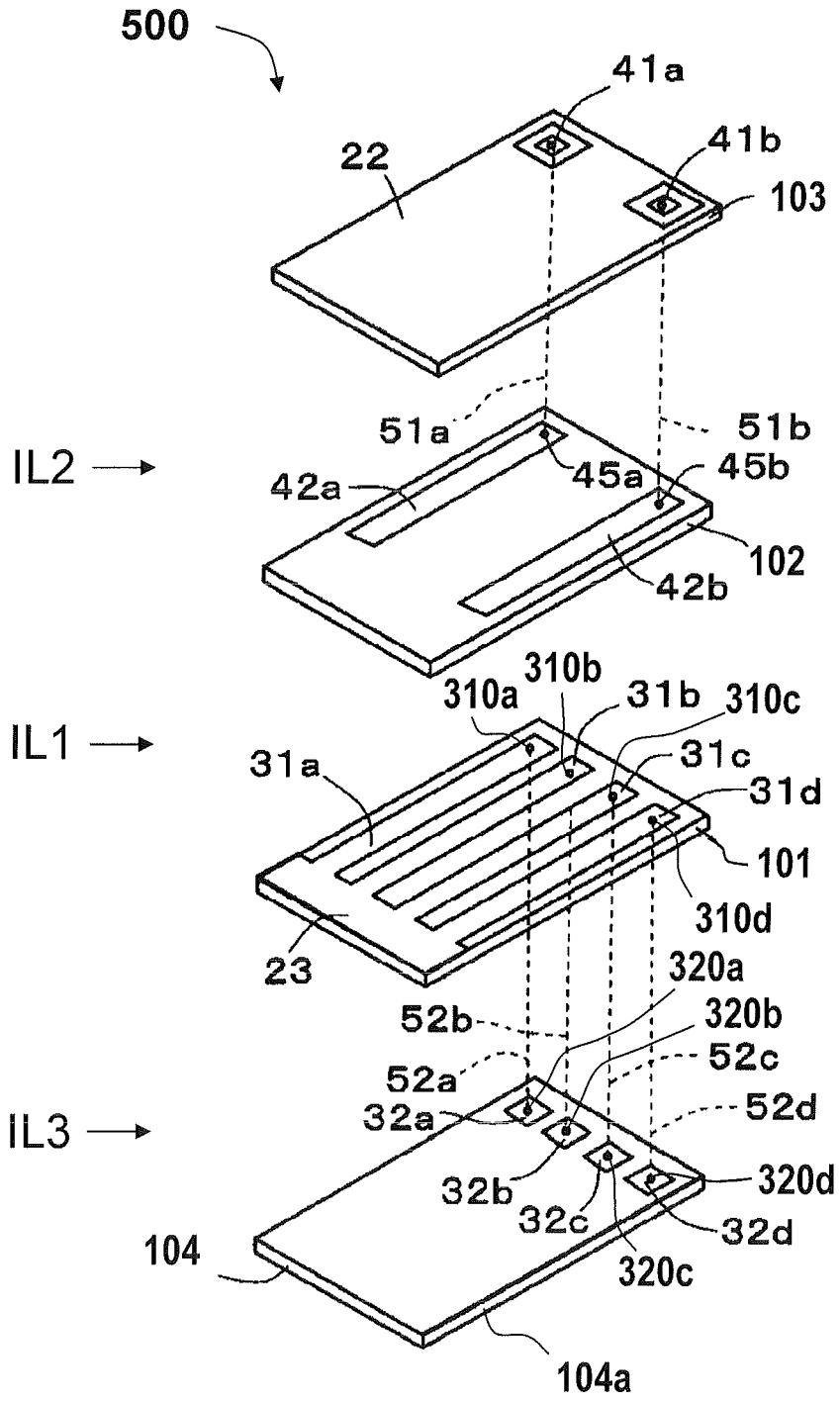
FIG. 6 is an exploded perspective view schematically illustrating the bandpass filter shown in FIG. 5.
Figures 7A, 7B, 7C, 7D, 7E:
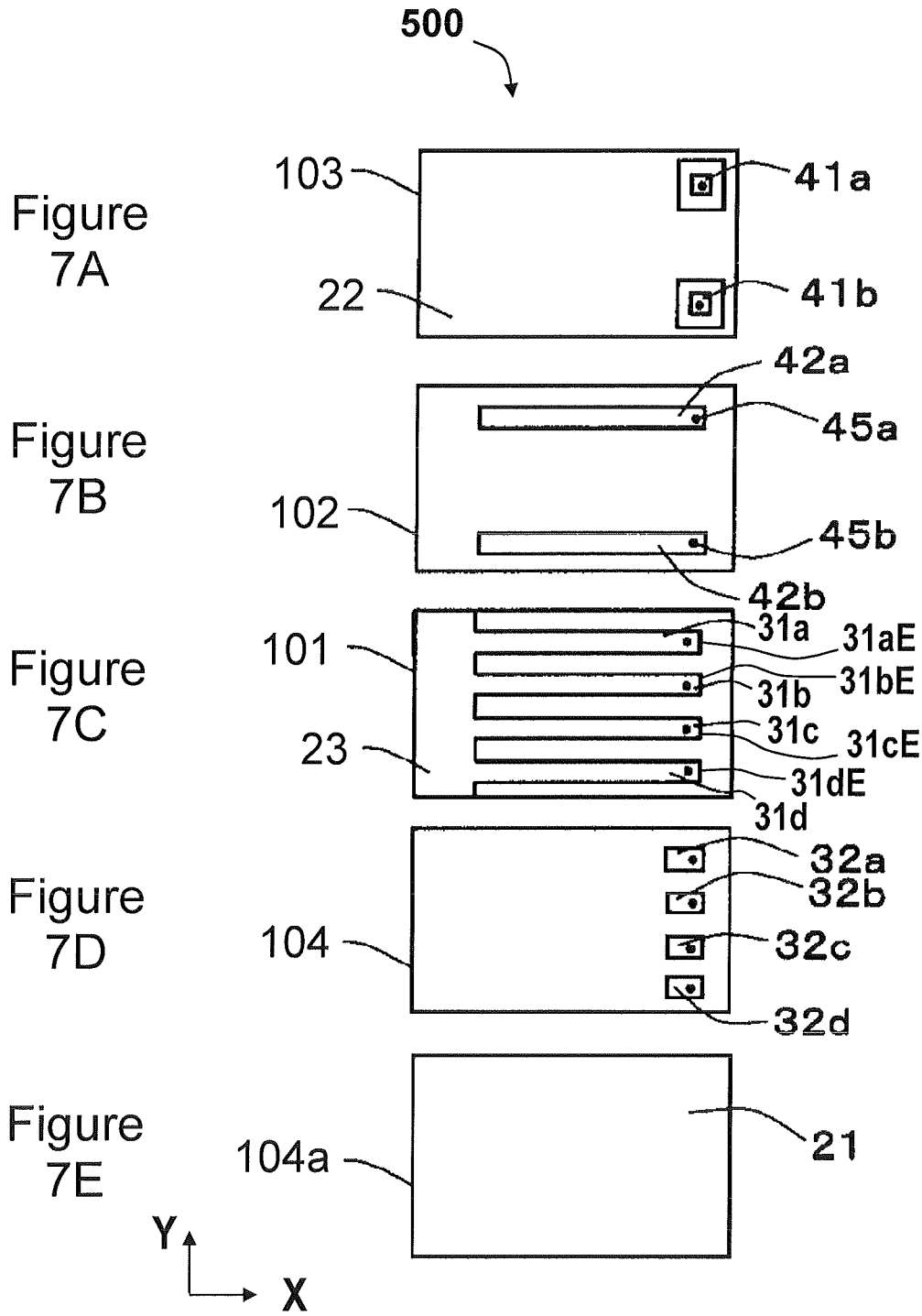
FIG. 7A is a plan view schematically illustrating a top surface of the bandpass filter shown in FIG. 5.
FIGS. 7B to 7D are plan views schematically illustrating inter-layers of the bandpass filter shown in FIG. 5.
FIG. 7E is a plan view schematically illustrating a bottom surface of the bandpass filter shown in FIG. 5.
Figure 8:
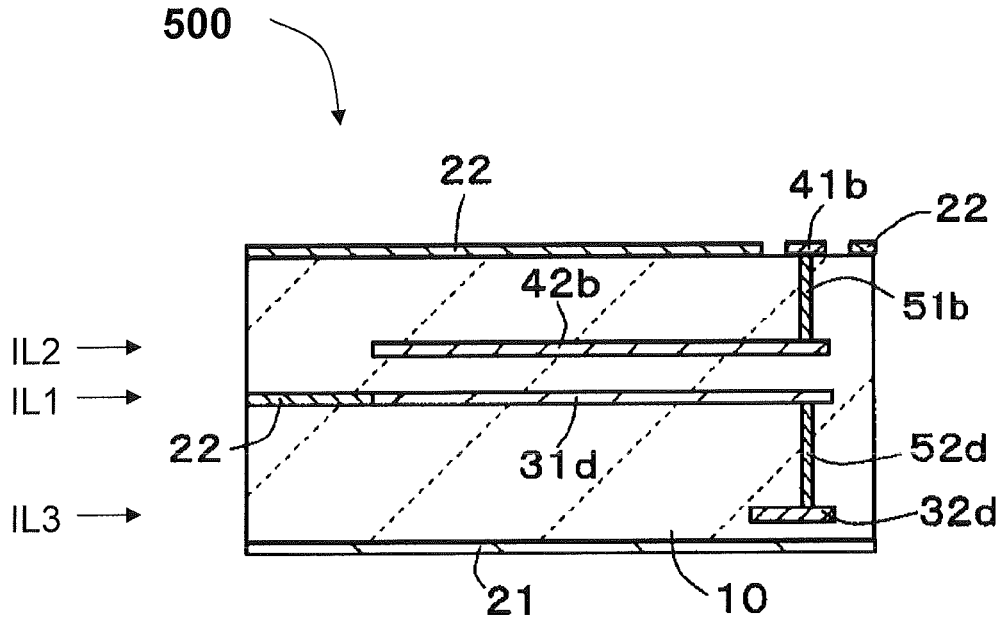
FIG. 8 is a cross sectional view taken along the line VIII-VIII shown in FIG. 5.

FIG. 5 is a perspective view schematically illustrating the external appearance of a bandpass filter according to an embodiment of the present invention. FIG. 6 is an exploded perspective view schematically illustrating the bandpass filter shown in FIG. 5. FIG. 8A is a plan view schematically illustrating a top surface of the bandpass filter shown in FIG. 5. FIGS. 7B to 7D are plan views schematically illustrating inter-layers of the bandpass filter shown in FIG. 5. FIG. 7E is a plan view schematically illustrating a bottom surface of the bandpass filter shown in FIG. 5. FIG. 8 is a cross sectional view taken along the line VIII-VIII shown in FIG. 5.

The following descriptions focus on only the differences from the embodiment shown in FIGS. 1 to 4, wherein the same reference numerals refer to the same constitutional elements, and therefore, the repetitive descriptions will be omitted.

A bandpass filter 500 comprises a laminated body 10. The laminate 10 comprises a dielectric layer 104 in addition to the dielectric layers 101, 102 and 103 in the embodiment shown FIGS. 1 to 4. In the same manner, the laminate 10 comprises a third inter-layers IL3 in addition to the inter-layers IL1 and IL2 in the embodiment shown FIGS. 1 to 4.

The first ground electrode 21 is located at a lower surface 104*a* of the dielectric layer 104.

The lengths of the resonant electrodes 31*a*, 31*b*, 31*c* and 31*d* are substantially identical. That is, the resonant electrodes 31*a*, 31*b*, 31*c* and 31*d* and the coupling electrodes 42*a* and 42*b* are substantially the same shape and dimension.

The input resonant electrode 31*a* comprises a first contact point 310*a* near the first open end 31*a*E. The second resonant electrode 31*b* comprises a second contact point 310*b* near the second open end 31*b*E. The third resonant electrode 31*c* comprises a third contact point 310*c* near the third open end 31*c*E. The output resonant electrode comprises a fourth contact point near the fourth open end 31*d*E.

In one embodiment, a bandpass filter 500 may comprise one or more auxiliary resonant electrodes. As shown in FIGS. 6 to 8, the bandpass filter 500 may comprise a first auxiliary resonant electrode 32*a*, a second auxiliary resonant electrode 32*b*, a third auxiliary resonant electrode 32*c* and a fourth auxiliary resonant electrode 32*d* on an upper surface of the dielectric layer 104.

Hereinafter, a group of the first auxiliary resonant electrode 32*a*, the second auxiliary resonant electrode 32*b*, the third auxiliary resonant electrode 32*c* and the fourth auxiliary resonant electrode 32*d* may be referred to auxiliary resonant electrodes 32*a*, 32*b*, 32*c* and 32*d*.

The first auxiliary resonant electrode 32*a* comprises a fifth contact point 320*a*. The fifth contact point 320*a* is connected to the first contact point 310*a* of the input resonant electrode

31*a* via a penetration conductor 52*a* which penetrates the dielectric layer 101. The fifth contact point 320*a* may face the first contact point 310*a*.

The second auxiliary resonant electrode 32*b* comprises a sixth contact point 320*b*. The sixth contact point 320*b* is connected to the second contact point 320*b* of the resonant electrode 31*b* via a penetration conductor 52*b* which penetrates the dielectric layer 101. The sixth contact point 320*b* may face the second contact point 310*b*.

The first auxiliary resonant electrode 32*c* comprises a seventh contact point 320*c*. The seventh contact point 320*c* is connected to the third contact point 310*c* of the resonant electrode 31*c* via a penetration conductor 52*c* which penetrates the dielectric layer 101. The seventh contact point 320*c* may face the first contact point 310*c*.

The fourth auxiliary output resonant electrode 32*d* comprises an eighth contact point 320*d*. The eighth contact point 320*d* is connected to the fourth contact point 320*d* of the output resonant electrode 31*d* via a penetration conductor 52*d* which penetrates the dielectric layer 101. The eighth contact point 320*d* may face the fourth contact point 310*d*.

The auxiliary resonant electrodes 32*a*, 32*b*, 32*c* and 32*d* may face a part of the first ground electrode 21. As a result, an electrostatic capacitance between the first ground electrode 21 and each of the auxiliary resonant electrodes 32*a*, 32*b*, 32*c* and 32*d* is generated. Accordingly, the lengths of the resonant electrodes 31*a*, 31*b*, 31*c* and 31*d* can be shortened to obtain a compact bandpass filter.

Alternatively, the auxiliary resonant electrodes 32*a*, 32*b*, 32*c* and 32*d* may be arranged such that the auxiliary resonant electrodes 32*a*, 32*b*, 32*c* and 32*d* face a part of the second ground electrode 22. Furthermore, some of the auxiliary resonant electrodes 32*a*, 32*b*, 32*c* and 32*d* may face a part of the first ground electrode 21 and the others may face the second ground electrode 22. In this case, the lengths of the coupling electrodes 42*a* and 42*b* may be adjusted to avoid the electrical contact with the first auxiliary resonant electrode 32*a* and the second auxiliary resonant electrode 32*d* if the first auxiliary resonant electrode 31*a* and the second auxiliary resonant electrode 32*d* are located near the coupling electrodes 42*a* and 42*b*. Specifically, the coupling electrodes 42*a* and 42*b* can be shorter in length not to touch the connection lines between the input coupling electrode 42*a* and the first auxiliary resonant electrodes 32*a*, and between the output coupling electrode 42*b* and the second auxiliary resonant electrodes 32*b*.

The auxiliary resonant electrodes 32*a*, 32*b*, 32*c* and 32*d* may have a desired shape such as a triangle, a square, and the like. The auxiliary resonant electrodes 32*a*, 32*b*, 32*c* and 32*d* can have, for example, rectangle shapes as shown in FIGS. 6 and 7D. In this case, the lengths of the resonant electrodes 32*a*, 32*b*, 32*c* and 32*d* may be shorter than a quarter of a wavelength in the central frequency of the bandpass filter (i.e., ¼ wavelength) in consideration of an electrostatic capacitance effect generated between the first ground electrode 21 and each of the auxiliary resonant electrodes 32*a*, 32*b*, 32*c* and 32*d*. The length of each resonant electrode is, for example and without limitation, about 2 to about 6 mm when the central frequency is 4 GHz and each of the dielectric layers have a specific permittivity of about 10.

Figure 9:
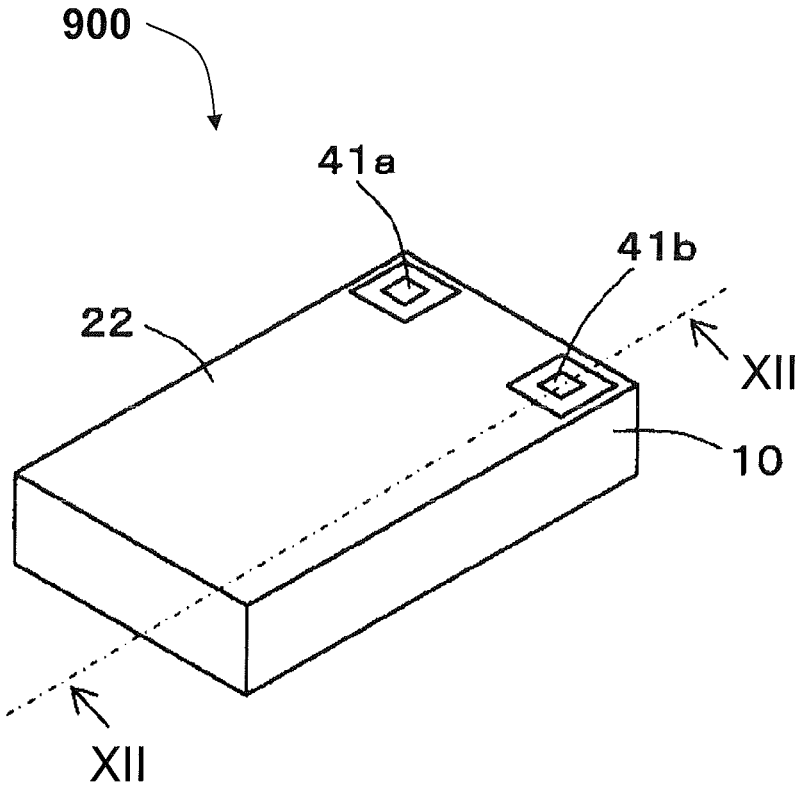
FIG. 9 is a perspective view schematically illustrating the external appearance of a bandpass filter according to one embodiment of the present invention.
Figure 10:
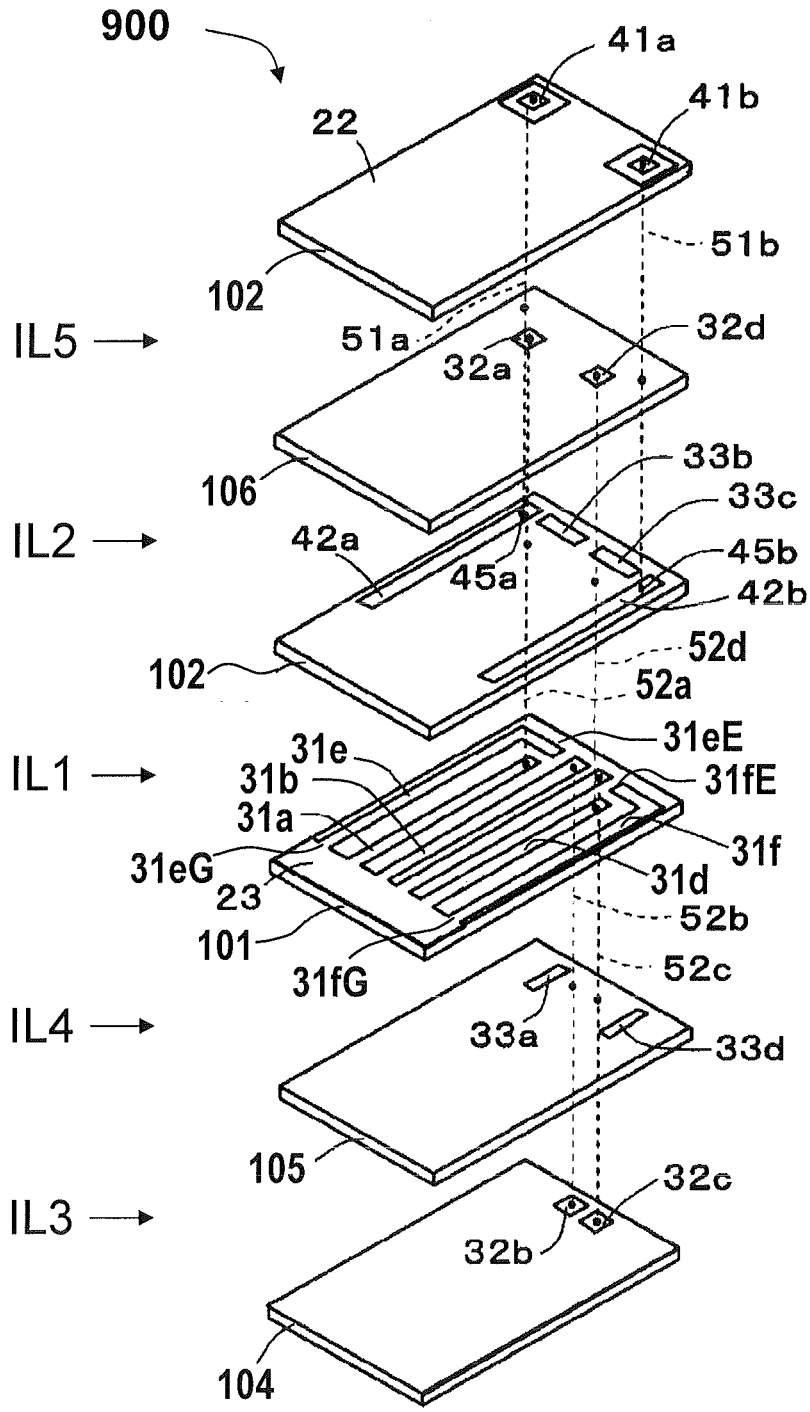
FIG. 10 is an exploded perspective view schematically illustrating the bandpass filter shown in FIG. 9.
Figure 11:
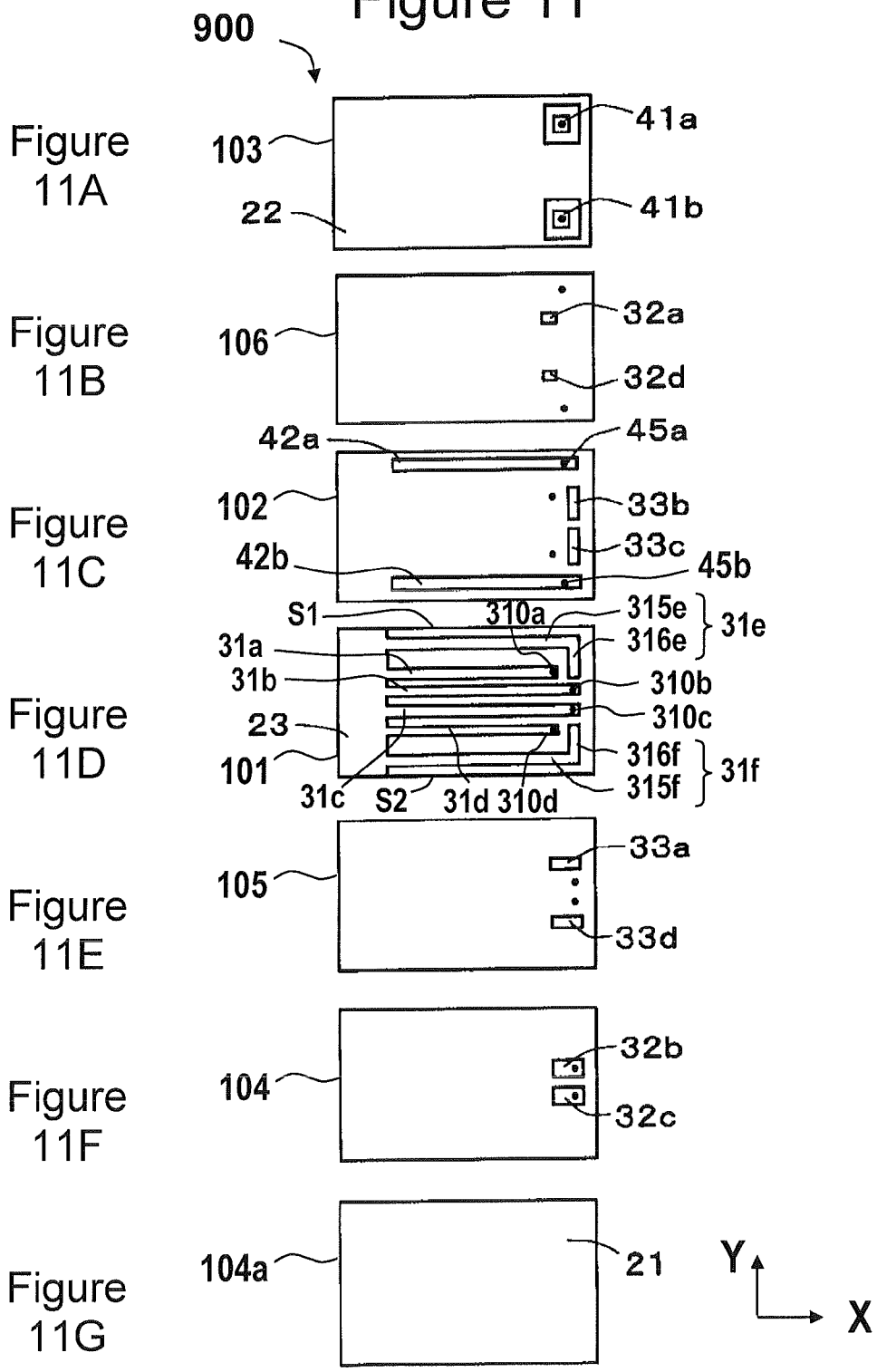
FIG. 11A is a plan view schematically illustrating a top surface of the bandpass filter shown in FIG. 9.
FIGS. 11B to 11F are plan views schematically illustrating inter-layers of the bandpass filter shown in FIG. 9.
FIG. 11G is a plan view schematically illustrating a bottom surface of the bandpass filter shown in FIG. 9.
Figure 12:
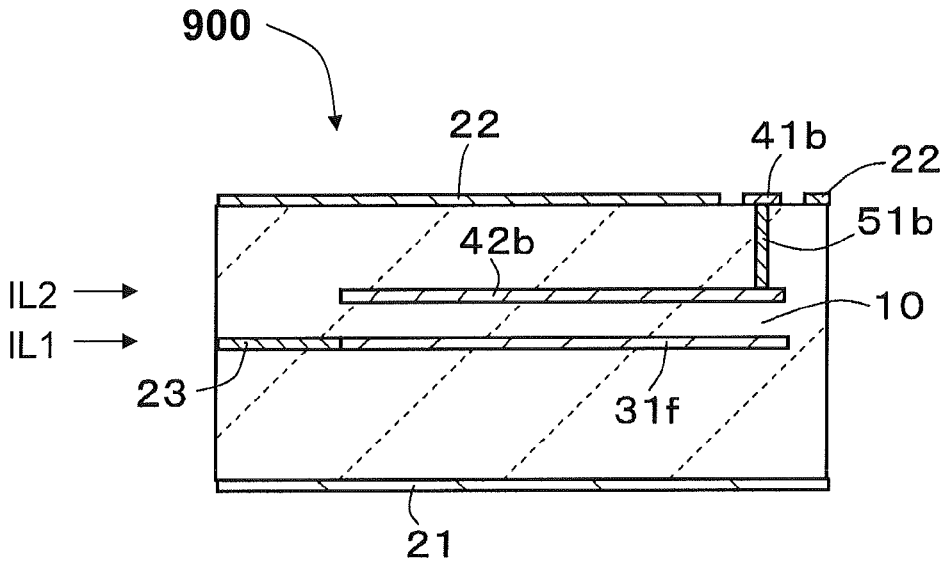
FIG. 12 is a cross sectional view taken along the line XII-XII shown in FIG. 9.

FIG. 9 is a perspective view schematically illustrating the external appearance of a bandpass filter according to one embodiment of the present invention. FIG. 10 is an exploded perspective view schematically illustrating the bandpass filter shown in FIG. 9. FIG. 11A is a plan view schematically illustrating a top surface of the bandpass filter shown in FIG. 9. FIGS. 11B to 11F are plan views schematically illustrating inter-layers of the bandpass filter shown in FIG. 9. FIG. 11G is a plan view schematically illustrating a bottom surface of the bandpass filter shown in FIG. 9. FIG. 12 is a cross sectional view taken along the line XII-XII shown in FIG. 9.

The following descriptions focus on the differences from the embodiments shown in FIGS. 1 to 4 and FIGS. 5 to 8, wherein the same reference numerals refer to the same constitutional elements, and therefore, the repetitive descriptions will be omitted.

A bandpass filter 900 comprises a laminated body 10. The laminate 10 comprises dielectric layers 105 and 106 in addition to the dielectric layers 101, 102, 103 and 104 in the embodiment shown FIGS. 5 to 8. The first ground electrode 21 is located on the bottom surface 104*a* of the dielectric layer 104.

The bandpass filter 900 further comprises a fifth resonant electrode 31*e* and a sixth resonant electrode 31*f* in addition to the first resonant electrode 31*a*, the second resonant electrode 31*b*, the third resonant electrode 31*c* and the fourth resonant electrode 31*d*. In this embodiment, the first resonant electrode 31*a*, the second resonant electrode 31*b*, the third resonant electrode 31*c*, the fourth resonant electrode 31*d*, the fifth resonant electrode 31*e* and the sixth resonant electrode 31*f* may be referred to resonant electrodes 31*a* to 31*f*. The resonant electrodes 31*a* to 31*f* are located on the dielectric layer 101.

Compared to the resonant electrodes 31*a*, 31*b*, 31*c* and 31*d* shown in FIGS. 1 to 4, two resonant electrodes (i.e., the fifth resonant electrode 31*e* and the sixth resonant electrode 31*f*) are added to the resonant electrodes 31*a*, 31*b*, 31*c* and 31*d* to make the resonant electrodes 31*a* to 31*f*. In other words, the fifth resonant electrode 31*e* is added to next of the first resonant electrode 31*a* at an outer side and the sixth resonant electrode 31*f* is added next of the fourth resonant electrodes 31*d* at an outer side. However, in the embodiments shown FIGS. 1 to 8, the first resonant electrode 31*a* is used as an input resonant electrode. In contrast, the fifth resonant electrode 31*e* in this embodiment is used as an input resonant electrode. In the same manner, the sixth resonant electrode 31*f* in this embodiment is uses as an output resonant electrode while the fourth resonant electrode 31*d* in the embodiment shown in FIGS. 1 to 8 is used as an output resonant electrode.

The fifth resonant electrode 31*e* comprises a fifth open end 31*e*E and a fifth ground end 31*e*G. The sixth resonant electrode 31*f* comprises a sixth open end 31*f*E and a sixth ground end 31*f*G. The ground ends 31*a*G, 31*b*G, 31*c*G, 31*d*G, 31*e*G and 31*f*G are aligned such that the electromagnetic field coupling is mutually provided, thereby mutually providing edge coupling.

The resonant electrodes 31*a* to 31*f*, the first ground electrode 21 and the second ground electrode 22 constitute a strip line resonator. Since one end of each of the resonant electrodes 31*a* to 31*f* is connected to the third ground electrode 23, each of the resonant electrodes 31*a* to 31*f* serves as a ¼ wavelength resonator.

In addition, the first ground end 31*a*G, the second ground end 31*b*G, the third ground end 31*c*G, the fourth ground end 31*d*G, the fifth ground end 31*e*G and the sixth ground end 31*f*G are connected to the third ground electrode 23. Therefore, the ground ends 31*a*G, 31*b*G, 31*c*G, 31*d*E, 31*e*E and 31*f*E are connected to the ground potential, and therefore, the resonant electrodes 31*a* to 31*f* are coupled in the form of the comb-line type.

The fifth resonant electrode 31*e* and the sixth resonant electrode 31*f* may have "L" shapes while the other resonant electrodes 31*a* to 31*d* have strip shapes or rectangle shapes.

The fifth resonant electrode 31*e* comprises a first long part 315*e* and a first short part 316*e*. The sixth resonant electrode 31*f* comprises a second long part 315*f* and a second short part 316*f*. The first long part 315*e* is close to the first side of the dielectric layer 101 while the second long part 315*f* is close to the second side of the dielectric layer 101. The first short part 316*e* and the second short part 316*f* sandwich a group of the resonant electrodes 31*b* and 31*c* at the open end side. The first short part 316*e* comprises the first open end 31*e*E. The second short part 316*f* comprises the second open end 31*f*E.

The bandpass filter 900 may comprise a first auxiliary resonant electrode 32*a*, a second auxiliary resonant electrode 32*b*, a third auxiliary resonant electrode 32*c* and a fourth auxiliary resonant electrode 32*d*, similar to the embodiment shown in FIGS. 5 to 8. However, in this embodiment, the first auxiliary resonant electrode 32*a* and a fourth auxiliary resonant electrode 32*d* are located on the dielectric layer 106 (or in the fifth inter-layer IL5) while the second auxiliary resonant electrode 32*b* and a third auxiliary resonant electrode 32*c* are located on the dielectric layer 104 (or in the third inter-layer IL3).

The auxiliary resonant electrodes 32*a* and 32*d* face a part of the second ground electrode 22. Therefore, the electrostatic capacitance is generated between the auxiliary resonant electrodes 32*a* and 32*d* and the second ground electrode 22, thereby shortening the lengths of the resonant electrodes 31*a* and 31*d*. Similarly, the auxiliary resonant electrodes 32*b* and 32*c* face the first ground electrode 21. Therefore, the electrostatic capacitance is generated between the resonant electrodes 32*b* and 32*c* and the first ground electrode 21, thereby shortening the lengths of the resonant electrodes 31*b* and 31*c*.

The first auxiliary resonant electrode 32*a* is electrically connected to the first contact point 310*a* of the other end of the resonant electrode 31*b* by the penetrating conductor 52*a* which penetrates the dielectric layers 102 and 106. The second auxiliary resonant electrode 32*b* is electrically connected to the second contact point 310*b* of the resonant electrode 31*b* by the penetrating conductor 52*b* which penetrates the dielectric layers 101 and 105. The third auxiliary resonant electrode 32*c* is electrically connected to the third contact point 310*c* of the resonant electrode 31*c* by the penetrating conductor 52*c* which penetrates the dielectric layers 101 and 105. The fourth auxiliary resonant electrode 32*d* is electrically connected to the fourth contact point 310*d* of the resonant electrode 31*d* by the penetrating conductor 52*d* which penetrates the dielectric layers 102 and 106.

The lengths of the resonant electrodes 31*a* and 31*d* may be set to be different from those of the resonant electrodes 31*b* and 31*c* for couplings of the resonant electrode coupling conductors. Accordingly, the electrostatic capacitance generated between the second ground electrode 22 and the auxiliary resonant electrodes 32*a* or 32*d* is set to be different from the electrostatic capacitance generated between the first ground electrode 21 or the auxiliary resonant electrodes 32*b* and 32*c*.

The input coupling electrode 42*a* faces a first part of the fifth resonant electrode 31*e*. The first part of the fifth resonant electrode 31*e* may be at least a half length of the first long part 315*e* of the fifth resonant electrode 31*e*. The output coupling electrode 42*b* faces a second part of the sixth resonant electrode 31*f*. The second part of the sixth resonant electrode 31*f* may be at least a half length of the second long part 315*f* of the sixth resonant electrode 31*f*.

The bandpass filter 900 further comprises a first resonant electrode coupling conductor 33*a*, a second resonant electrode coupling conductor 33*b*, a third resonant electrode coupling conductor 33*c* and a fourth resonant electrode coupling conductor 33*d*. The first resonant electrode coupling conductor 33*a*, the second resonant electrode coupling conductor 33*b*, the third resonant electrode coupling conductor 33*c* and the fourth resonant electrode coupling conductor 33*d* may be referred as resonant electrode coupling conductors 33*a*, 33*b*, 33*c* and 33*d*.

The first resonant electrode coupling conductor 33*a* and the fourth resonant electrode coupling conductor 33*d* are located in the dielectric layer 105 (or in the fourth inter-layer IL4) while the second resonant electrode coupling conductor 33*b* and the third resonant electrode coupling conductor 33*c* are located in the dielectric layer 102 (or in the fourth inter-layer IL2) where the input coupling electrode 42*a* and the output coupling electrode 42*b* are located.

The resonant electrode coupling conductors 33*a*, 33*b*, 33*c*, and 33*d* face two of the resonant electrodes 31*a* to 31*f*. Specifically, for example, the first resonant electrode coupling conductor 33*a* faces a part of the first short part 316*a* of the first resonant electrode 31*a* including the first open end 31*a*E and a part of the fifth resonant electrode 31*e* including the fifth open end 31*e*E, and therefore, the electric field coupling is provided between the first resonant electrode 31*a* and the fifth resonant electrode 31*e* by the resonant electrode coupling conductor 33*a*. The second resonant electrode coupling conductor 33*b* faces a part of the second resonant electrode 31*b* including the second open end 31*b*E and a part of the first short part 316*a* of the fifth resonant electrode 31*e* including the fifth open end 31*e*E, and therefore, the electric field coupling is provided between the second resonant electrode 31*b* and the fifth resonant electrode 31*e* by the second resonant electrode coupling conductor 33*b*.

In the same manner, the third resonant electrode coupling conductor 33*c* faces a part of the third resonant electrode 31*c* including the third open end 31*c*E and a part of the second short part 316*f* of the sixth resonant electrode 31*f* including the sixth open end 31*f*E, and therefore, the electric field coupling is provided between the third resonant electrode 31*c* and the sixth resonant electrode 31*f* by the resonant electrode coupling conductor 33*c*. The fourth resonant electrode coupling conductor 33*d* faces a part of the fourth resonant electrode 31*d* including the second open end 31*d*E and a part of the second short part 316*f* of the sixth resonant electrode 31*f* including the sixth open end 31*f*E, and therefore, the electric field coupling is provided between the fourth resonant electrode 31*d* and the sixth resonant electrode 31*f* by the fourth resonant electrode coupling conductor 33*d*.

The above mentioned couplings by using the resonant electrode coupling conductors 33*a*, 33*b*, 33*c*, and 33*d* allow forming an attenuation pole on the high frequency side of the passband. If a steep attenuation property is required for a bandpass filter in order to reduce interference with another system, the resonant electrode coupling conductors 33*a*, 33*b*, 33*c*, and 33*d* can provide such an attenuation pole to obtain the bandpass filter having the wide passband and steep attenuation property.

Figure 13:
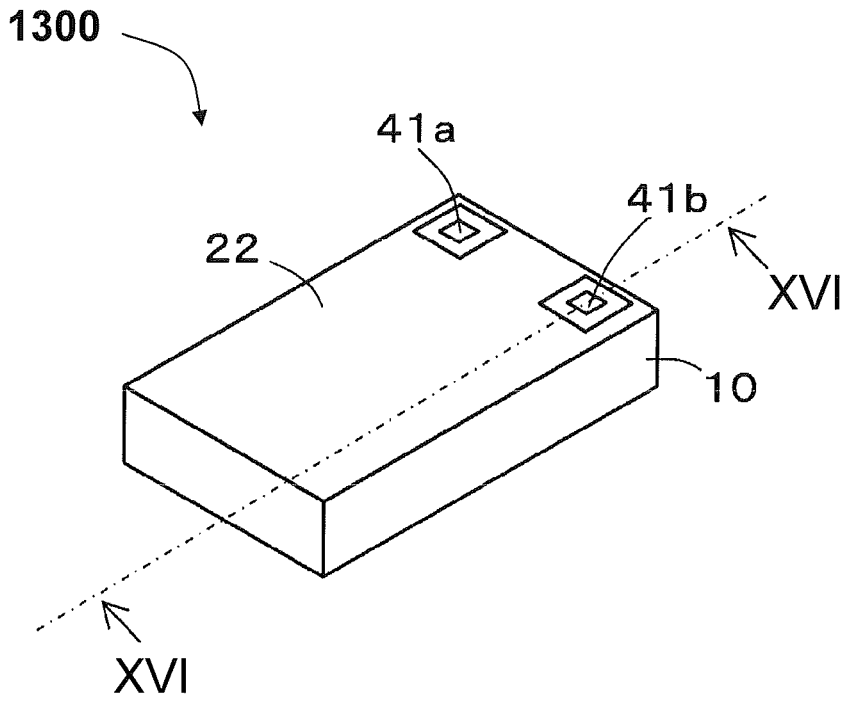
FIG. 13 is a perspective view schematically illustrating the external appearance of a bandpass filter according to one embodiment of the present invention.
Figure 14:
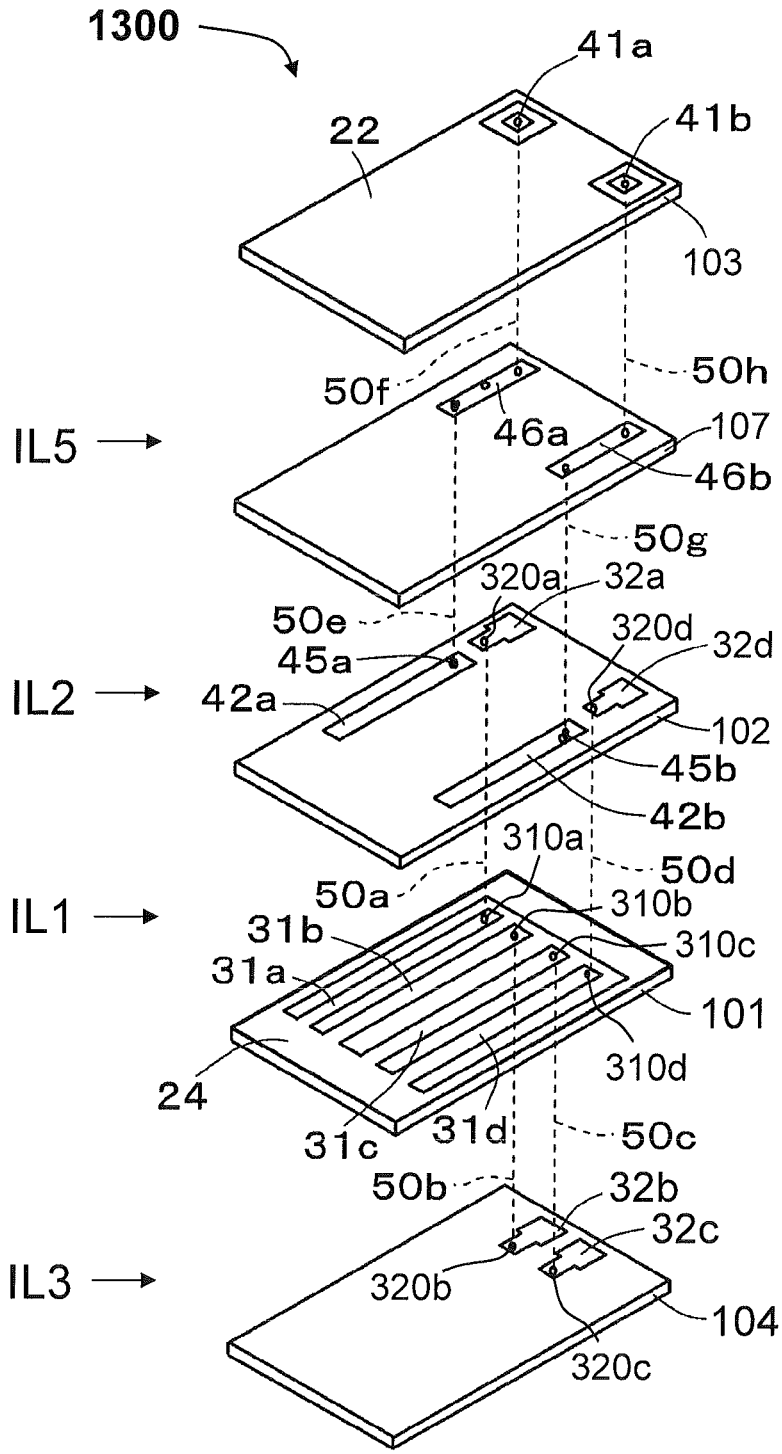
FIG. 14 is an exploded perspective view schematically illustrating the bandpass filter shown in FIG. 13.
Figures 15A, 15B, 15C, 15D, 15E, 15F:
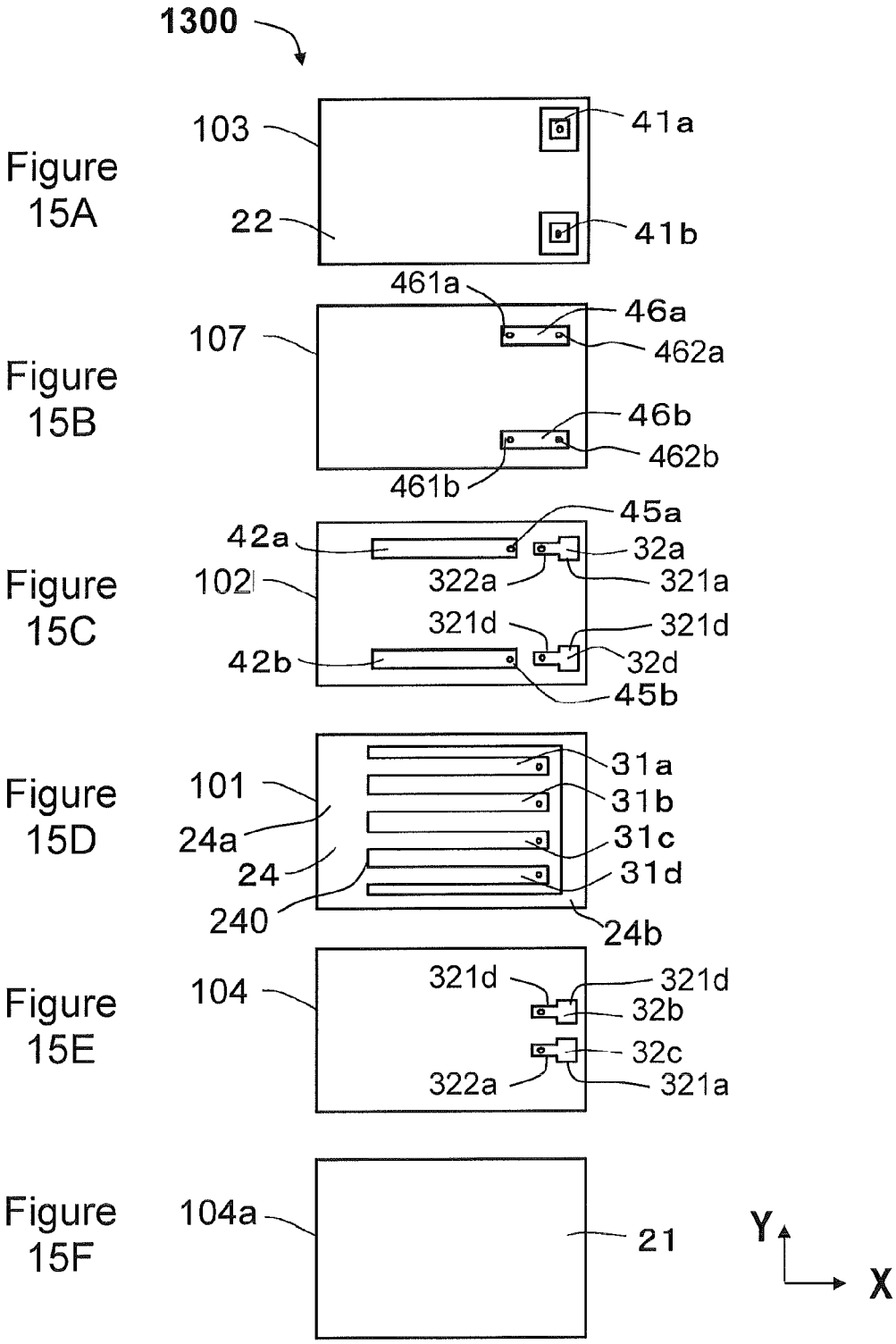
FIG. 15A is a plan view schematically illustrating a top surface of the bandpass filter shown in FIG. 13.
FIGS. 15B to 15E are plan views schematically illustrating inter-layers of the bandpass filter shown in FIG. 13.
FIG. 15F is a plan view schematically illustrating a bottom surface of the bandpass filter shown in FIG. 13.
Figure 16:
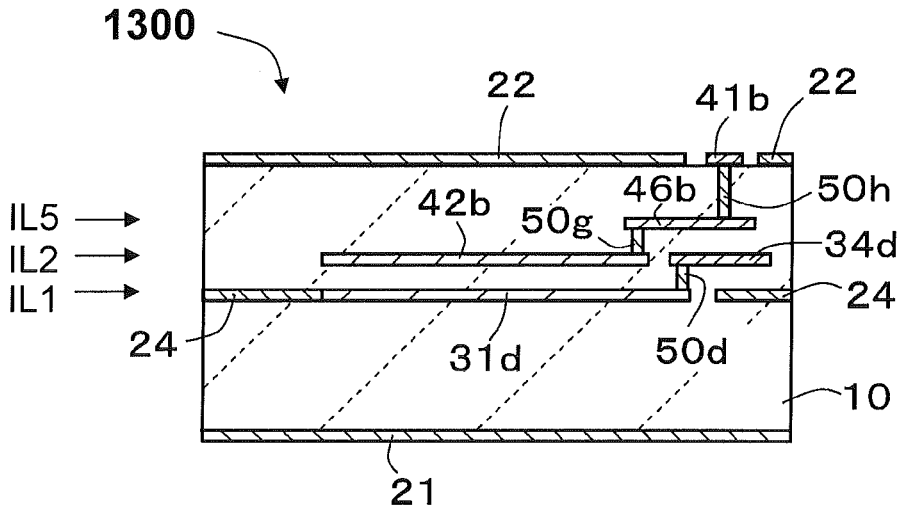
FIG. 16 is a cross sectional view taken along the line XVI-XVI shown in FIG. 13.

FIG. 13 is a perspective view schematically illustrating the external appearance of a bandpass filter according to one embodiment of the present invention. FIG. 14 is an exploded perspective view schematically illustrating the bandpass filter shown in FIG. 13. FIG. 15A is a plan view schematically illustrating a top surface of the bandpass filter shown in FIG. 13. FIGS. 15B to 11E are plan views schematically illustrating inter-layers of the bandpass filter shown in FIG. 13. FIG. 15F is a plan view schematically illustrating a bottom surface of the bandpass filter shown in FIG. 13. FIG. 16 is a cross sectional view taken along the line XVI-XVI shown in FIG. 13.

The following descriptions focus on the differences from the embodiments shown in FIGS. 1 to 4, FIGS. 5 to 8 and FIGS. 9 to 12, wherein the same reference numerals refer to the same constitutional elements, and therefore, the repetitive descriptions will be omitted.

A bandpass filter 900 comprises a laminated body 10. The laminate 10 comprises dielectric layers 101, 102, 103, 104 and 107. The first ground electrode 21 is located on the bottom surface 104*a* of the dielectric layer 104.

The bandpass filter 1300 comprises four resonant electrodes 31*a*, 31*b*, 31*c* and 31*d*, which are similar to the embodiment shown in FIGS. 5 to 8. The resonant electrodes 31*a*, 31*b*, 31*c* and 31*d* may have the same shape. The resonant electrodes 31*a*, 31*b*, 31*c* and 31*d* comprise the first contact point 310*a*, the second contact point 310*b*, the third contact point 310*c* and the fourth contact point 310*d* as shown in the aforementioned embodiments.

The bandpass filter 1300 may comprise an annular ground electrode 24 on the dielectric layer 101. In other words, a U-shape part 24*b* is added to a strait part 24*a* which is equivalent to the third ground electrode 23 in the aforementioned embodiments to make the annular ground electrode 24. The annular ground electrode 24 surrounds the resonant electrodes 31*a*, 31*b*, 31*c* and 31*d*. As described in the aforementioned embodiments, the ground ends 31*a*G, 31*b*G, 31*c*G and 31*d*G of the resonant electrodes 31*a*, 31*b*, 31*c* and 31*d* are connected to an inner side 240. Therefore, the circular ground electrode 24 can reduce a leakage of an electromagnetic wave generated from the resonant electrodes 31*a*, 31*b*, 31*c* and 31*d* to the surroundings. This effect may be effective in preventing a harmful influence of the module board.

The input coupling electrode 42*a* faces at least a half of the region in the longitudinal direction of the input resonant electrode 31*a* (or first resonant electrode 31*a*), and therefore, the electromagnetic field coupling is provided between the input coupling electrode 42*a* and the input resonant electrode 31*a*.

In the same manner, the output coupling electrode 42*b* faces at least a half of the region in the longitudinal direction of the output resonant electrode 31*d* (or fourth resonant electrode 31*d*), and therefore, the electromagnetic field coupling is provided between the output coupling electrode 42*b* and the output resonant electrode 31*d*.

The bandpass filter 1300 may comprise the auxiliary resonant electrode 32*a*, 32*b*, 32*c* and 32*d*, similar to the embodiment shown in FIGS. 9 to 12. However, compared to the auxiliary resonant electrode 32*a*, 32*b*, 32*c* and 32*d* in the embodiment shown in FIGS. 9 to 12, the locations and the shapes are different. That is, the auxiliary resonant electrodes 32*a* and 32*d* are located on the dielectric layer 102 (or in the second inter-layer IL2). The auxiliary resonant electrodes 32*a* and 32*d* are adjacent to the input coupling electrode 42*a* and the output coupling electrode 42*b*, respectively. The auxiliary resonant electrodes 32*b* and 32*c* are located on the dielectric layer 104 (or in the third inter-layer IL3).

In addition, the auxiliary resonant electrodes 32*a*, 32*b*, 32*c* and 32*d* in this embodiment can have "T" shapes. Alternatively, the auxiliary resonant electrodes 31*a*, 31*b*, 31*c* and 31*d* may have a desired shape such as a triangle, a square, and the like. The auxiliary resonant electrodes 31*a*, 31*b*, 31*c* and 31*d* can have the fifth contact point 320*a*, the sixth contact point 320*b*, the seventh contact point 320*c* and the eighth contact point 320*d*, respectively, as same as in the aforementioned embodiments.

The first auxiliary input resonant electrode 32*a* comprises a first portion 321*a* and a second portion 322*a*. A part of the first portion 321*a* comprises an area which faces a part of the annular ground electrode 24. The second portion 322*a* comprises the fifth contact point 320*a* which is electrically connected to the first connection point 310*a* of the input resonant electrode 31*a* (or first resonant electrode 31*a*) via a penetration conductor 50*a*.

The second auxiliary resonant electrode 32*b* comprises a first portion 321*b* and a second portion 322*b*. A part of the first portion 321*b* comprises an area which faces a part of the annular ground electrode 24. The second portion 322*b* comprises the sixth contact point 320*b* which is electrically connected to the second connection point 310*b* of the second resonant electrode 31*b* via a penetration conductor 50*b*.

The third auxiliary input resonant electrode 32*c* comprises a first portion 321*c* and a second portion 322*c*. A part of the first portion 321*c* comprises an area which faces a part of the annular ground electrode 24. The second portion 322*c* comprises the seventh contact point 320*c* which is electrically connected to the third connection point 310*c* of the third resonant electrode 31*c* via a penetration conductor 50*c*.

The fourth auxiliary input resonant electrode 32*d* comprises a first portion 321*d* and a second portion 322*d*. A part of the first portion 321*d* comprises an area which faces a part of the annular ground electrode 24. The second portion 322*d* comprises the eighth contact point 320*d* which is electrically connected to the third connection point 310*d* of the output resonant electrode 31*d* (or fourth resonant electrode 31*d*) via a penetration conductor 50*d*.

The auxiliary resonant electrodes 32*a*, 32*b*, 32*c*, and 32*d* can serve as a part of the resonant electrodes 31*a*, 31*b*, 31*c*, and 31*d*. In other words, the first resonant electrodes 31*a* is extended in length by adding the auxiliary resonant electrodes 32*a*, so as the other resonant electrodes 31*b*, 31*c*, and 31*d*. Then, the electrostatic capacitance is generated between the circular ground electrode 24 and each of the auxiliary resonant electrodes 32*a*, 32*b*, 32*c*, and 32*d*, and therefore, the generated electrostatic capacitance is added to the electrostatic capacitance between the ground potential and the resonant electrodes 31*a*, 31*b*, 31*c*, and 31*d*, so that the lengths of the resonant electrodes can be shortened to obtain the compact bandpass filter.

The bandpass filter 1300 may comprise an input auxiliary coupling electrode 46*a* and an output auxiliary coupling electrode 46*b* on the dielectric layer 107 or in a fourth inter-layer IL5. The input auxiliary coupling electrode 46*a* comprises a region facing at least a part of the input auxiliary resonant electrode 32*a*. The output auxiliary coupling electrode 46*b* comprises a region facing at least a part of the output auxiliary resonant electrode 32*b*.

The auxiliary input coupling electrode 46*a* comprises a first signal connecting point 461*a* which is connected to the electric signal input point 45*a* of the input coupling electrode 42*a* via a penetrating conductor 50*e*. The auxiliary output coupling electrode 46*b* comprises a second signal connecting point 461*b* which is connected to the electric signal output point 45*b* of the output coupling electrode 42*b* via a penetrating conductor 50*f*.

The auxiliary input coupling electrode 46*a* comprises a third signal connecting point 462*a* which is connected to the input terminal electrode 41*a* via a penetrating conductor 50*f*. The auxiliary output coupling electrode 46*b* comprises a second signal connecting point 461*b* which is connected to the electric signal output point 45*b* of the output terminal electrode 41*b* via a penetrating conductor 50*h*.

The auxiliary coupling electrodes 46*a*, 46*b* can serve as a part of the coupling electrodes 42*a*, 42*b*, respectively. In other words, the input coupling electrode 42*a* is extended in length by the auxiliary input coupling electrode 46*a*. Similarly, the output coupling electrode 42*b* is extended in length by the auxiliary output coupling electrode 46*b*.

The auxiliary input coupling electrode 46*a* comprises a region facing the input auxiliary resonant electrode 32*a*. The auxiliary output coupling electrode 46*b* comprises a region facing the output auxiliary resonant electrode 32*b*. Consequently, the electromagnetic field coupling between the input coupling electrode 42*a* and the input resonant electrode 31*a* and the electromagnetic field coupling between the output coupling electrode 42*b* and the output resonant electrode 31*d* are further strengthened, the flat, low-loss passband property can be obtained over the wide passband region even in the wide passband such as UWB. In the flat, low-loss passband property, the increase in insertion loss is further reduced in the frequency located between resonant frequencies of each resonant mode.

An electric signal is fed from an external circuit into the input coupling electrode 42*a* through the auxiliary input coupling electrode 46*a*. An electric signal supplied from the output coupling electrode 42*b* is taken out to an external circuit through the auxiliary output coupling electrode 46*b*. The input coupling electrode 42*a* and the input resonant electrode 31*a* are coupled in the form of the inter-digital type, and the output coupling electrode 42*b* and the output resonant electrode 31*d* are coupled in the form of the inter-digital type. Therefore, the coupling of the magnetic field and the coupling of the electric field are added to generate the strong coupling.

Therefore, the coupling area between the input resonant electrode 31*a* and the input coupling electrode 42*a* is added by the coupling area between the input auxiliary resonant electrode 32*a* and the auxiliary input coupling electrode 46*a*. The coupling area between the output resonant electrode 31*d* and the output coupling electrode 42*d* is added by the coupling area between the input auxiliary resonant electrode 32*d* and the auxiliary input coupling electrode 46*d*. Consequently, the broadside coupling is provided between the input resonant electrode 31*a* and the input auxiliary resonant electrode 32*a* and the input coupling electrode 42*a* and the auxiliary input coupling electrode 46*a*, and thereby providing a strong electromagnetic field coupling.

The coupling between a resonance area of the input resonant electrode 31*a* added by the input auxiliary resonant electrode 32*a* and a resonance area of the coupling body of the input coupling electrode 42*a* added by the auxiliary input coupling electrode 46*a* are coupled in the form of the inter-digital type. Therefore, the coupling becomes stronger in the length direction of the auxiliary input coupling electrode 46*a* compared with the case in which the end portion on the same side as the side connected to the input coupling electrode 42*a* is connected to the input terminal electrode 41*a*.

The increase in insertion loss is further reduced at a frequency located between the resonant frequencies of the resonant modes even in the extremely wide passband, and the flat, low-loss passband property can be obtained in the whole region of the wide passband.

The number of resonant electrodes is not limited to four and six. The number resonant electrodes may be determined by the necessary passband width and the electric property such as attenuation outside the passband. However, when the number of resonant electrodes is excessively increased, the bandpass filter is often increased or the loss is often increased in the passband. Therefore, in one embodiment, the number of resonant electrodes may be set to about 10 or less.

A wireless communication module and a wireless communication device according to one embodiment of the invention may use any one of the bandpass filters mentioned in the above embodiments.

Figure 17:
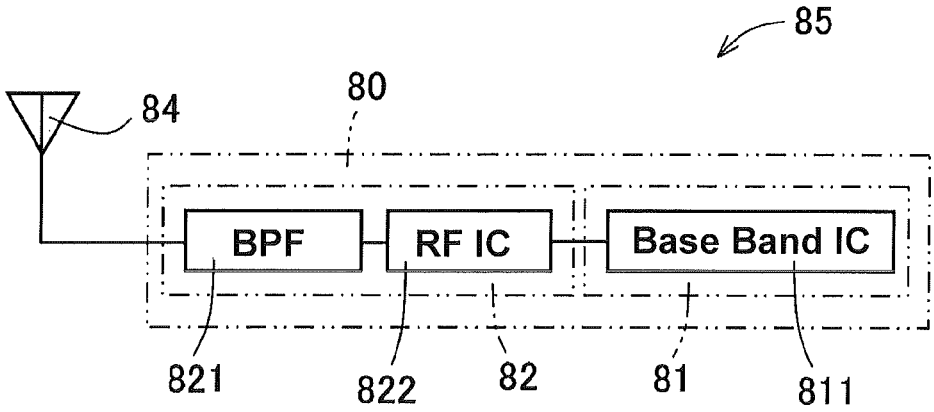
FIG. 17 is a block diagram illustrating a constructional example of a wireless communication device using the bandpass filter according to one embodiment of the present invention.

FIG. 17 is a block diagram illustrating a constructional example of a wireless communication module 80 and a wireless communication device 85 using the wireless communication module 80 according to an embodiment of the present invention, which utilizes a bandpass filter according to the embodiments of the present invention.

The wireless communication module 80 comprises a base band module 81 that performs a processing of a base band signal, and a RF module 82 connected to the base band module 81 and configured to perform a RF signal processing before modulating the base band signal and after reconstructing the signal.

The RF module 82 comprises the bandpass filter 821. The bandpass filter 821 can reduce RF signals modulated of the base band signal or received RF signals at a frequency range other than the pass band.

Specifically, the base band module comprises a base band IC 811, and RF module 82 further comprises a RF IC 822 between the pass filter 821 and base band module 81. The wireless communication can comprise another circuit between these modules.

The wireless communication device 85 further comprises an antenna 184 connected to the bandpass filter 821 of the high frequency module 80. When passing through the bandpass filter 821, a transmission signal outputted from the wireless communication device 85 is transmitted through the antenna 84. When passing through the bandpass filter 821, a receipt signal received through the antenna 84 enters into the wireless communication device 85, with the signals having frequencies other than the communication band attenuated.

In the bandpass filters according to the embodiments of the present invention, the dielectric layers may comprise a resin such as epoxy resin, or ceramics such as dielectric ceramics. For example, a glass-ceramic material may be appropriately used which comprises a dielectric ceramic material such as $BaTiO_3$, $Pb_4Fe_2Nb_2O_{12}$, $TiO_2$ and a glass material such as $B_2O_3$, $SiO_2$, $Al_2O_3$, ZnO and may be sinterable at a relatively low temperature of about 800° C. to 1200° C. Further, the thickness of the dielectric layers 101 to 107 is set, for example and without limitation, to about 0.01 to about 0.1 mm.

A conductive material whose principle constituent is an Ag alloy of, for example, Ag, Ag—Pd, and Ag—Pt or Cu-based, W-based, Mo-based, and Pd-based conductive material is fairly appropriately used for the above-described various electrodes and penetration conductors. The thickness of the various electrodes is set, for example and without limitation, on the order of 0.001 to 0.2 mm.

The bandpass filters according to the above embodiments may be manufactured, for example, as follows. To begin with, a proper organic solvent is added to ceramic based powder and mixed to form slurry and then form a ceramic green sheet by a doctor blade method. Next, through-holes for penetration conductors, are formed at the obtained ceramic green sheet using a punching machine, and conductive paste such as Ag, Ag—Pd, Au, and Cu, is filled in the through-holes to form penetration conductors. Thereafter, the above described various electrodes are formed on the ceramic green sheet by lithography. Then, these are stacked and pressurized by a hot press device, and fired at a high temperature of 800° C. to 1050° C.

Example 1

Electrical properties of the bandpass filter comprising a structure as shown in FIGS. 5 to 8 were calculated by an electromagnetic field simulator. The following conditions were used for calculation: relative dielectric constant of the dielectric layers is 9.4; dissipation factor of the dielectric layers is 0.0005; and conductivity of various electrodes is $3.0*10^7$ S/m.

As the shape measurements, the resonant electrodes 31*a*, 31*b*, 31*c* and 31*d* were adapted to have the width (or length in Y direction in FIGS. 7A to 7E) of 0.15 mm, the length (or length in X direction in FIGS. 7A to 7E) of 2.65 mm and the intervals of 0.15 mm between two adjacent resonant electrodes.

The input coupling electrodes 42*a* and the output coupling electrodes 42*b* were adapted to have the width of 0.15 mm and the length of 2.65 mm. The electrode dimensions of the auxiliary resonant electrodes 32*a*, 32*b*, 32*c* and 32*d* were adjusted such that the electrostatic capacitance is set to about 0.5 to about 1.5 pF.

Figure 18:
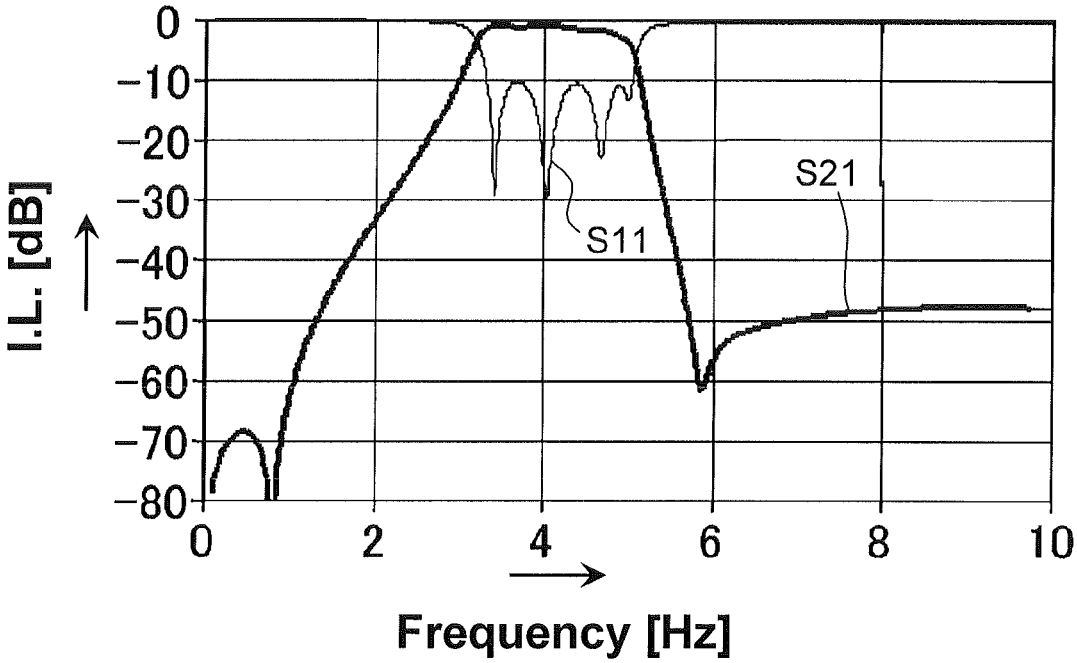
FIG. 18 is a graph showing a result of simulation regarding an electrical characteristic of the bandpass filter shown in FIGS. 5 to 8.

FIG. 18 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

The graph illustrated in FIG. 18 shows the pass characteristics (S21) has a low loss in the frequency range of 3.2 GHz to 4.7 GHz that corresponds to 40% by the relative bandwidth, which is even broader than the region realized by the conventional filter using the conventional ¼ wavelength resonator. As such, it could be possible to achieve a good transmission characteristic of being flat and of low loss over the entire region of the broad pass band and therefore the effectiveness of the present invention might be verified.

Example 2

Electrical properties of the bandpass filter comprising a structure as shown in FIGS. 9 to 12 were calculated by an electromagnetic field simulator.

The following conditions were used for calculation: relative dielectric constant of the dielectric layers is 9.4; dissipation factor is 0.0005; and conductivity is $3.0*10^7$ S/m.

As the shape measurements, the resonant electrodes 31*a*, 31*b*, 31*c*, 31*d*, 31*e* and 31*f* were adapted to have the width (or length in Y direction in FIGS. 11A to 11G) of 0.2 mm, the length (or length in X direction in FIGS. 11A to 11G) of 3.5 mm and the intervals of 0.15 mm between two adjacent resonant electrodes.

The input coupling electrodes 42*a* and the output coupling electrodes 42*b* were adapted to have the width of 0.2 mm and the length of 3.5 mm, and the auxiliary coupling electrodes 41*a*, 41*c* and the auxiliary output coupling electrodes 41*b*, 41*d* were adapted to have the width of 0.3 mm and the length of 1.45 mm.

The electrode dimensions of the auxiliary resonant electrodes 32*a*, 32*b*, 32*c* and 32*d* were adjusted such that the electrostatic capacitance is set to about 0.5 to about 1.5 pF.

Figure 19:
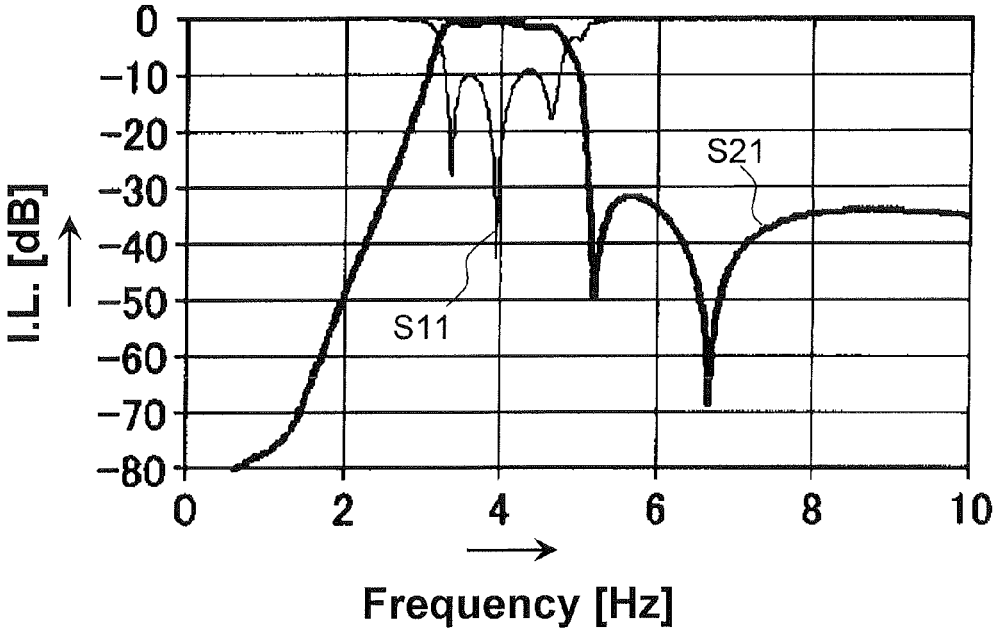
FIG. 19 is a graph showing a result of simulation regarding an electrical characteristic of the bandpass filter shown in FIGS. 9 to 12.

FIG. 19 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

The graph illustrated in FIG. 19 shows the pass characteristics (S21) has a low loss in the frequency range of 3.2 GHz to 4.7 GHz that corresponds to 40% by the relative bandwidth.

In addition, there is an attenuation pole at 5.2 GHz with the loss characteristic of 30 dB.

Example 3

Electrical properties of the bandpass filter comprising a structure as shown in FIGS. 13 to 16 were calculated by an electromagnetic field simulator. The following conditions were used for calculation: relative dielectric constant of the dielectric layers is 9.4; dissipation factor is 0.0005; and conductivity is $3.0*10^7$ S/m.

As the shape measurements, the resonant electrodes 31*a*, 31*b*, 31*c*, 31*d*, 31*e* and 31*f* were adapted to have rectangle shapes with a width (or length in Y direction in FIGS. 15A to 15F) of 0.15 mm, a length of 3.0 mm and the intervals of 0.15 mm between two adjacent resonant electrodes. The intervals between the first resonant electrode 31*a* and the second resonant electrode 31*b*, and between the third resonant electrode 31*c* and the fourth resonant electrode 31*d* were 0.1025 mm, and the interval between the second resonant electrode 31*b* and third resonant electrode 31*c* was 0.095 mm.

The input coupling electrodes 42*a* and the output coupling electrodes 42*b* were adapted to have the width of 0.15 mm and the length of 2.7 mm, and the auxiliary coupling electrodes 46 and 46*b* were adapted to have the width of 0.15 mm and the length of 1.0 mm.

The first portions of the auxiliary resonant electrodes 32*a* and 32*d* have widths of 0.35 mm and the lengths of 0.4 mm at a position from a right edge of the dielectric layer 102, and the second portions have the width of 0.15 mm and the length of 0.45 mm.

The first portions of the auxiliary resonant electrodes 32*b* and 32*c* have widths of 0.425 mm and the lengths of 0.425 mm at a position from a right edge of the dielectric layer 104, and the second portions have the width of 0.15 mm and the length of 0.45 mm.

The input terminal electrode 41*a* and the output terminal electrode 41*b* have square shapes with a side of 2.4 mm. Each of the first ground electrode, the second ground electrode, and the outer shape of the circular ground electrode 24 has a rectangular shape with a length of 5 mm and a width of 2.4 mm, and the opening of the circular ground electrode 24 is 1.6 mm in width and a length of 3.2 mm.

The entire bandpass filter has a width of 2.4 mm, a length of 5 mm, and a thickness of 1.0 mm, and the resonant electrodes 31*a*, 31*b*, 31*c* and 31*d* and the circular ground electrode 24 are located in the center of the bandpass filter in the thickness direction. The thickness of the dielectric layers 102 and 103 are 0.015 mm and the diameters of the penetration conductors are 0.1 mm.

Figure 20:
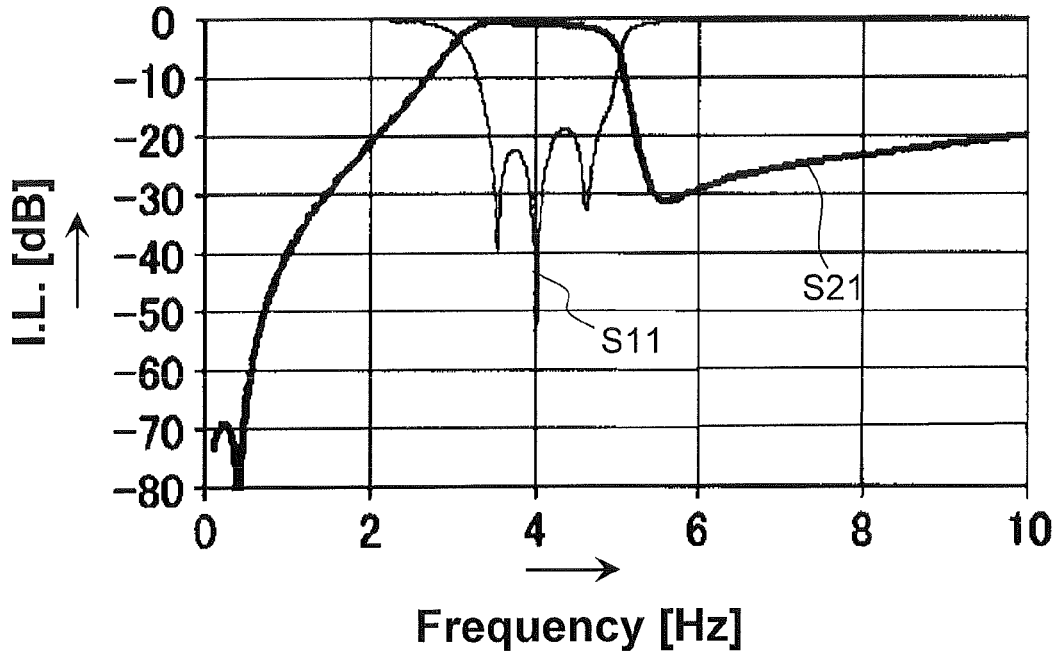
FIG. 20 is a graph showing a result of simulation regarding an electrical characteristic of the bandpass filter shown in FIGS. 13 to 16.

FIG. 20 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

The graph illustrated in FIG. 20 shows the reflecting property (S11) is about −20 dB over substantially the whole frequency range of 3.2 GHz to 4.7 GHz that corresponds to 40% by the relative bandwidth.

In this bandpass filter, the coupling generated by using the resonant electrodes 31*a*, 31*b*, 31*c* and 31*d* is strong, and therefore, the passband property (S21) is flat and low loss.

While at least one exemplary embodiment has been presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being included within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A bandpass filter, comprising:

a laminate comprising a plurality of dielectric layers;

a first ground electrode on or in the laminate;

a plurality of resonant electrodes in a first inter-layer portion of the laminate, comprising:

an input resonant electrode;

an output resonant electrode; and one or more resonant electrodes, wherein the input resonant electrode, the output resonant electrode and the one or more resonant electrodes are in parallel, wherein each of the input resonant electrode, the output resonant electrode and the one or more resonant electrodes has a ground end and an open end, wherein the ground ends of the input resonant electrode, the output resonant electrode and the one or more resonant electrodes are aligned, and the ground ends are connected to a ground potential;

an input coupling electrode in a second inter-layer portion of the laminate, having a strip shape, facing at least a half of a length of the input resonant electrode, and comprising a signal input point operable to input an electric signal, wherein the signal input point is located between an end of the input coupling electrode near the open end of the input resonant electrode and a center of a facing area of the input coupling electrode which faces the input resonant electrode;

an output coupling electrode in the second inter-layer portion, having a strip shape, facing at least a half of a length of the output resonant electrode, and comprising a signal output point operable to output an electric signal, wherein the signal output point is located between an end of the output coupling electrode near the open end of the output resonant electrode and a center of a facing area of the output coupling electrode which faces the output resonant electrode;

an annular ground electrode surrounding the plurality of resonant electrodes and to which the ground ends of the plurality of resonant electrodes are connected;

a plurality of auxiliary resonant electrodes in the second inter-layer portion of the laminate that comprises:

an input auxiliary resonant electrode on the second inter-layer portion that is connected to the input resonant electrode via a conductor and that faces a part of the annular ground electrode such that a capacitance is generated between the annular ground electrode and the input auxiliary resonant electrode, and an output auxiliary resonant electrode on the second inter-layer portion that is connected to the output resonant electrode via a conductor and that faces a part of the annular ground electrode such that a capacitance is generated between the annular ground electrode and the output auxiliary resonant electrode, an input auxiliary coupling electrode in a fifth inter-layer portion of the laminate, electrically connected to the signal input point of the input coupling electrode via a conductor, and comprising an area facing the input auxiliary resonant electrode such that an electromagnetic field coupling is generated between the input auxiliary resonant electrode and the input auxiliary, coupling electrode; and an output auxiliary coupling electrode in the fifth inter-layer portion of the laminate, electrically connected to the signal output point of the output coupling electrode via a conductor, and comprising an area facing the output auxiliary resonant electrode such that an electromagnetic field coupling is generated between the output auxiliary resonant electrode and the output auxiliary coupling electrode.

2. The bandpass filter according to claim 1, wherein each of the plurality of resonant electrodes is operable to be electromagnetically coupled to a neighboring one of the plurality of resonant electrodes, wherein the input resonant electrode is operable to be electromagnetically coupled to the input coupling electrode, and the output resonant electrode is operable to be electromagnetically coupled to the output coupling electrode.

3. The bandpass filter according to claim 1, further comprising a second plurality of auxiliary resonant electrodes in a third inter-layer portion of the laminate, each connected to one of the plurality of resonant electrodes at the open end side, and each facing the annular ground electrode.

4. A wireless communication module, comprising:

an RF module comprising a bandpass filter according to claim 1; and a base band module connected to the RF module.

5. A wireless communication device, comprising:

an RF module comprising a bandpass filter according to claim 1;

a base band module connected to the RF module; and an antenna connected to the bandpass filter.

* * * * *